US011103035B2

(12) United States Patent
Disinger

(10) Patent No.: US 11,103,035 B2
(45) Date of Patent: Aug. 31, 2021

(54) LIGHT-EMITTING JEWELRY

(71) Applicant: NG DEVELOPMENTS, LLC, Huntingburg, IN (US)

(72) Inventor: John W. Disinger, Santa Claus, IN (US)

(73) Assignee: NG DEVELOPMENTS, LLC, Huntingburg, IN (US)

( * ) Notice: Subject to any disclaimer, the term of this patent is extended or adjusted under 35 U.S.C. 154(b) by 106 days.

(21) Appl. No.: 15/430,966

(22) Filed: Feb. 13, 2017

(65) Prior Publication Data

US 2017/0231336 A1 Aug. 17, 2017

Related U.S. Application Data

(60) Provisional application No. 62/296,120, filed on Feb. 17, 2016, provisional application No. 62/310,241, filed on Mar. 18, 2016.

(51) Int. Cl.

| | |
|---|---|
| ***A44C 17/02*** | (2006.01) |
| ***A44C 15/00*** | (2006.01) |
| ***A44C 1/00*** | (2006.01) |
| ***A44C 5/00*** | (2006.01) |
| ***A44C 7/00*** | (2006.01) |
| ***A44C 9/00*** | (2006.01) |
| ***A44C 17/00*** | (2006.01) |
| ***A44C 25/00*** | (2006.01) |

(52) U.S. Cl.

CPC ..... *A44C 15/0015* (2013.01); *A44C 1/00* (2013.01); *A44C 5/0007* (2013.01); *A44C 7/00* (2013.01); *A44C 9/0053* (2013.01); *A44C 17/007* (2013.01); *A44C 17/02* (2013.01); *A44C 25/001* (2013.01); *A44C 17/00* (2013.01)

(58) Field of Classification Search

CPC ..... A44C 17/02; A44C 15/0015
USPC ..... D11/91, 92
See application file for complete search history.

(56) References Cited

U.S. PATENT DOCUMENTS 634,567 A * 10/1899 Ballou et al. ..... A44C 17/02 63/26
837,615 A * 12/1906 Dover ..... A44C 17/02 63/20
1,064,152 A 6/1913 Meyer
1,211,240 A * 1/1917 Ryan ..... A44C 17/02 362/341

(Continued)

FOREIGN PATENT DOCUMENTS

CN 102754975 10/2012
EP 2179672 A1 * 4/2010 ..... A44C 17/001

(Continued)

OTHER PUBLICATIONS

International (PCT) Search Report and Written Opinion for PCT/US2018/000249 dated Dec. 20, 2018, BD-105 PCT ||, 10 pages.

(Continued)

*Primary Examiner* — Emily M Morgan
(74) *Attorney, Agent, or Firm* — Dentons Bingham Greenebaum LLP; Brian W. Chellgren

(57) ABSTRACT

A light-emitting jewelry piece includes a gemstone, a head, and a mounting. The head is configured to interconnect the gemstone to the mounting. The mounting is arranged to secure the light-emitting jewelry piece to a person or a personal adornment.

19 Claims, 11 Drawing Sheets

(56) References Cited

U.S. PATENT DOCUMENTS

Figure 1:
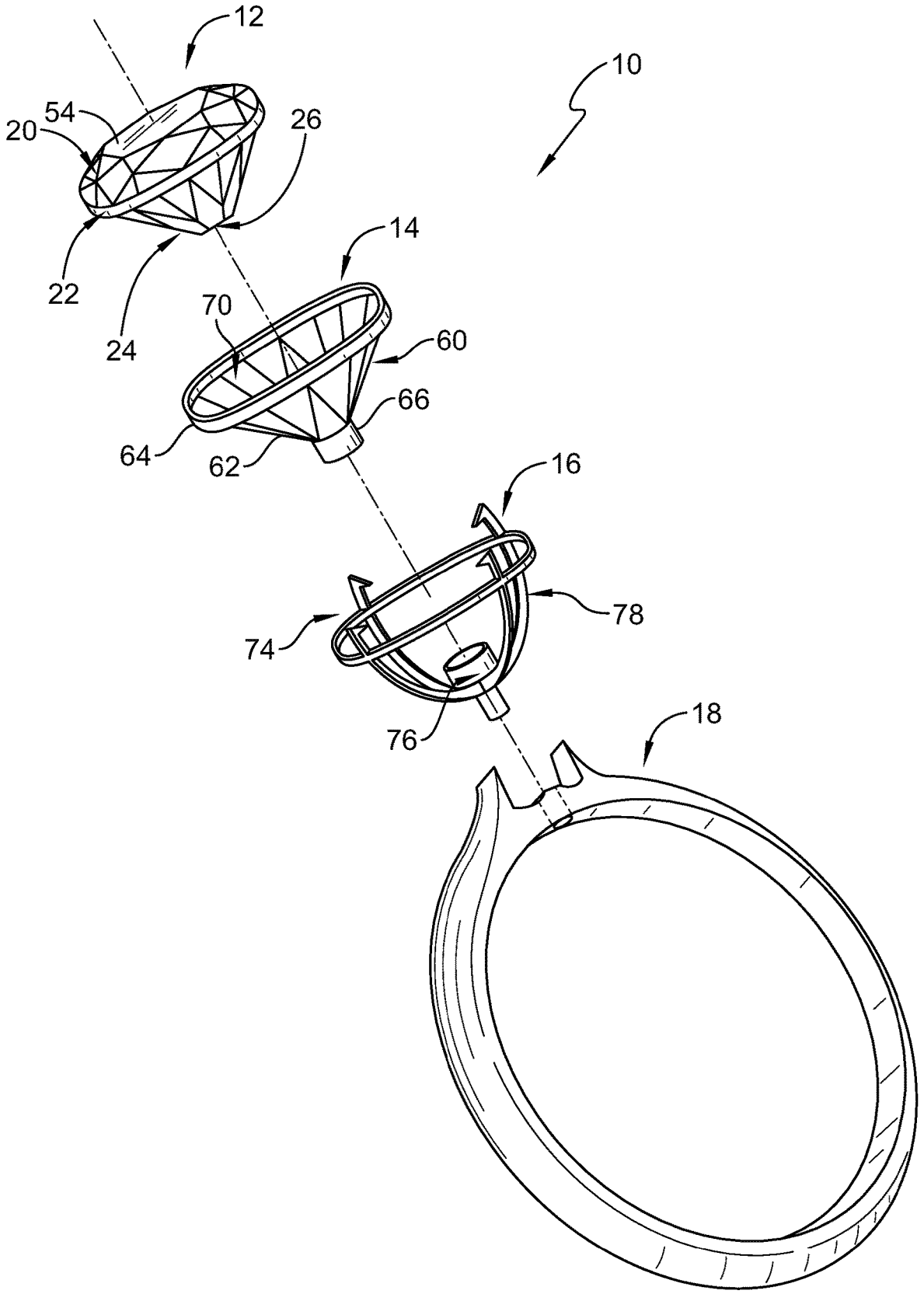

| | | | | |
|---|---|---|---|---|
| 1,293,028 | A * | 2/1919 | Campbell | A44C 17/02 63/26 |
| 1,392,604 | A | 10/1921 | Smith | |
| 1,548,645 | A * | 8/1925 | Akeson | A44C 9/00 63/15 |
| 1,812,058 | A | 6/1931 | Paul | |
| 4,781,038 | A * | 11/1988 | Branca | A44C 11/007 59/80 |
| 4,942,744 | A | 7/1990 | Wei | |
| 5,022,238 | A * | 6/1991 | German | A44C 17/02 63/26 |
| 5,323,300 | A * | 6/1994 | McCrary | A44C 15/0015 362/104 |
| 5,758,945 | A | 6/1998 | Lima | |
| 6,422,038 | B1 * | 7/2002 | Chin | A44C 17/02 63/26 |
| 6,928,834 | B2 | 8/2005 | Robertson | |
| 6,990,833 | B2 | 1/2006 | Smith | |
| 6,997,014 | B2 | 2/2006 | Starcke | |
| 7,222,980 | B1 | 5/2007 | Pinciaro | |
| 7,526,928 | B1 | 5/2009 | Kearnes | |
| D632,205 | S | 2/2011 | Mehta | |
| 8,769,987 | B2 | 7/2014 | Mehta | |
| 8,844,319 | B2 | 9/2014 | Weingarten | |
| 2002/0134107 | A1 * | 9/2002 | Meguro | A44C 25/00 63/26 |
| 2002/0152767 | A1 * | 10/2002 | Gruber | A44C 17/005 63/26 |
| 2002/0166339 | A1 * | 11/2002 | Adelman | A44C 17/005 63/29.1 |
| 2003/0221452 | A1 | 12/2003 | Morbidoni | |
| 2004/0065114 | A1 * | 4/2004 | Robertson | A44C 9/00 63/27 |
| 2004/0083759 | A1 | 5/2004 | Starcke | |
| 2005/0044890 | A1 | 3/2005 | Lodholz | |
| 2006/0000236 | A1 * | 1/2006 | Chan | A44C 9/00 63/27 |
| 2007/0006615 | A1 | 1/2007 | Noda | |
| 2007/0036921 | A1 | 2/2007 | Twitchen | |
| 2007/0157667 | A1 | 7/2007 | Maltezos | |
| 2008/0087042 | A1 | 4/2008 | Heimann | |
| 2008/0104994 | A1 * | 5/2008 | Braunwart | A44C 17/005 63/13 |
| 2009/0038341 | A1 | 2/2009 | Zheng | |
| 2009/0260396 | A1 | 10/2009 | Broukman | |
| 2011/0030422 | A1 | 2/2011 | Kang | |
| 2011/0110201 | A1 | 5/2011 | Boularas | |
| 2012/0060557 | A1 | 3/2012 | van Looveren | |
| 2012/0096898 | A1 | 4/2012 | Van Looveren | |
| 2013/0227989 | A1 | 9/2013 | Kothari | |
| 2015/0007610 | A1 | 1/2015 | Greulich | |
| 2015/0068248 | A1 * | 3/2015 | Conner | A44C 17/02 63/28 |
| 2015/0075217 | A1 | 3/2015 | Disinger | |
| 2019/0037978 | A1 * | 2/2019 | Haramein | A44C 13/00 |

FOREIGN PATENT DOCUMENTS

| | | | | |
|---|---|---|---|---|
| EP | 2179672 | A1 | 4/2010 | |
| EP | 2179672 | | 4/2012 | |
| GB | 182138 | A | 9/1923 | |
| GB | 2136672 | A | 9/1984 | |
| JP | 8103310 | A | 4/1996 | |
| RU | 164561 | U1 | 9/2016 | |
| WO | 200069303 | | 11/2000 | |
| WO | 2009121908 | | 10/2009 | |
| WO | 2014023064 | | 2/2014 | |
| WO | WO-2019159910 | A1 * | 8/2019 | A44C 25/00 |

OTHER PUBLICATIONS

Office Action dated Jul. 17, 2018 for U.S. Appl. No. 15/239,907, BD-101 US-CON1 || (pp. 1-12).

Office Action dated Apr. 23, 2019 for U.S. Appl. No. 15/239,907 (pp. 1-13).

U.S. Office Action for U.S. Appl. No. 15/239,907 dated Sep. 1, 2017, BD-101 US-CON1 ||, 10 pages.

European Search Report for European App. No. 17156176.4, dated Jun. 26, 2017, BD-104 EP ||, 8 pages.

* cited by examiner

LIGHT-EMITTING JEWELRY

PRIORITY CLAIM

This application claims priority under 35 U.S.C. § 119(e) to U.S. Provisional Application No. 62/296,120, filed Feb. 17, 2016, and to U.S. Provisional Application No. 62/310,241, filed Mar. 18, 2016, each of which are expressly incorporated by reference herein.

BACKGROUND

The present disclosure relates to jewelry, and particularly to jewelry including a gemstone. More particularly, the present disclosure relates to jewelry configured to communicate light through the gemstone.

SUMMARY

According to the present disclosure, a jewelry piece includes a gemstone. The gemstone may be a piece of material used to make an adornment such as, for example, a mineral, a crystal, metal, rock, plastic, glass, cubic zirconia, colored gemstone, whether precious or non-precious, natural diamond, and lab-created diamond. In some embodiments, the jewelry piece further includes a head. The head interconnects the gemstone to a mounting for securing the jewelry piece to a person or a personal adornment.

In some embodiments, the jewelry piece is a light-emitting jewelry piece including a gemstone and a light-emission system. The light-emission system is configured to provide means for emitting light over time in response to receiving and storing light to cause light visible to a person to be emitted through the gemstone. The light emitted through the gemstone may be more visible by a person when the light-emitting jewelry is in a dusk to dark environment.

In some embodiments, the gemstone includes a crown, a girdle, a pavilion, and a culet. In some embodiments, a crown angle is defined between an outer crown surface of the crown and a top edge of the girdle and the crown angle is in a range of about 36 degrees up to and including about 45 degrees. In some embodiments, a pavilion angle is defined between an outer pavilion surface of the pavilion and a bottom edge of the girdle and the pavilion angle is in a range of about 36 degrees up to and including about 45 degrees.

In some embodiments, the gemstone has a width and the girdle has a girdle height in a range of about 4 percent up to about 9 percent of the width of the gemstone. In some embodiments, the culet is mated with a portion of the light-emission system. In some embodiments, the culet includes a culet width in a range of about 9 percent up to about 22 percent of the width of the gemstone.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

Figure 2:
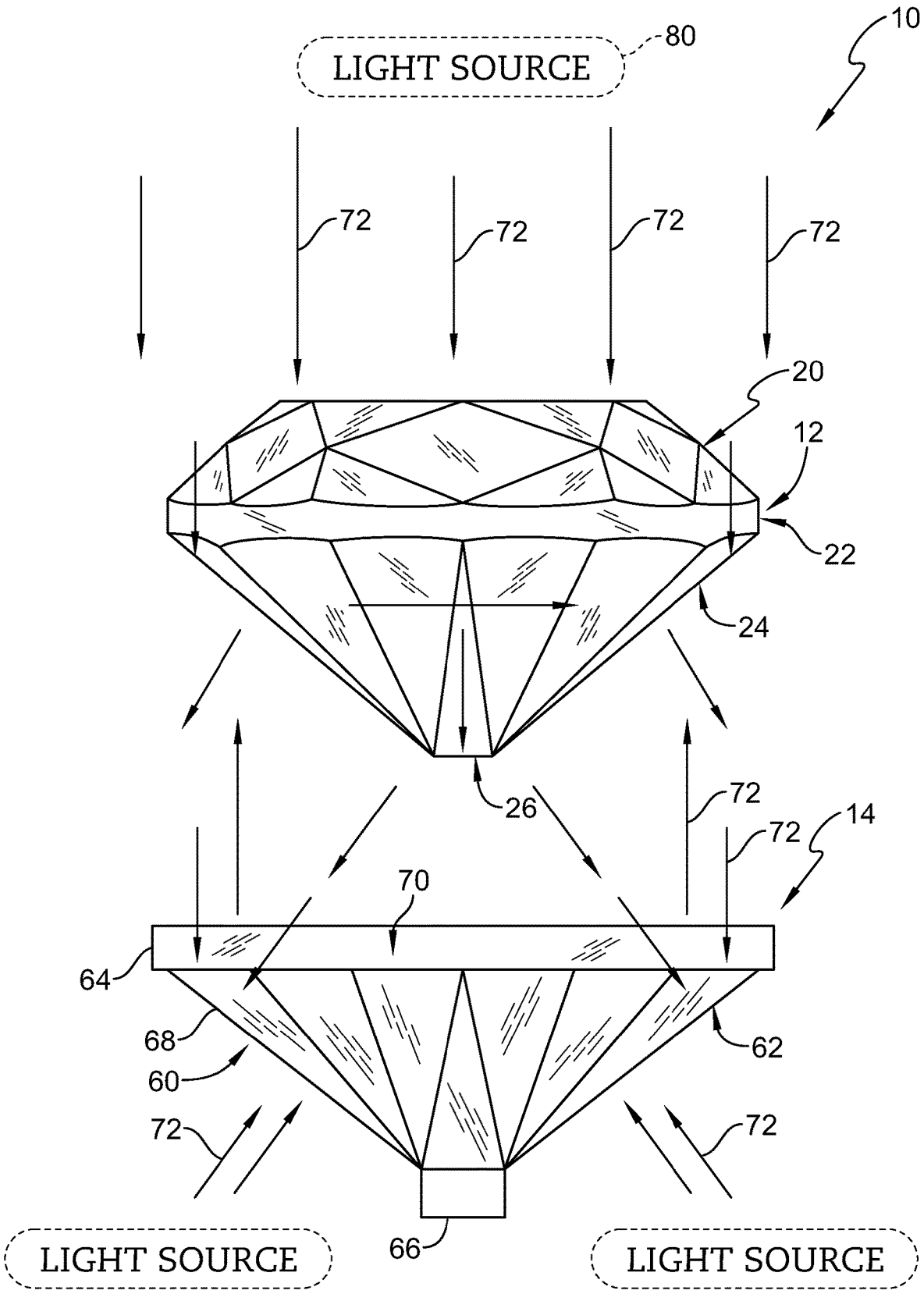
Figure 4:
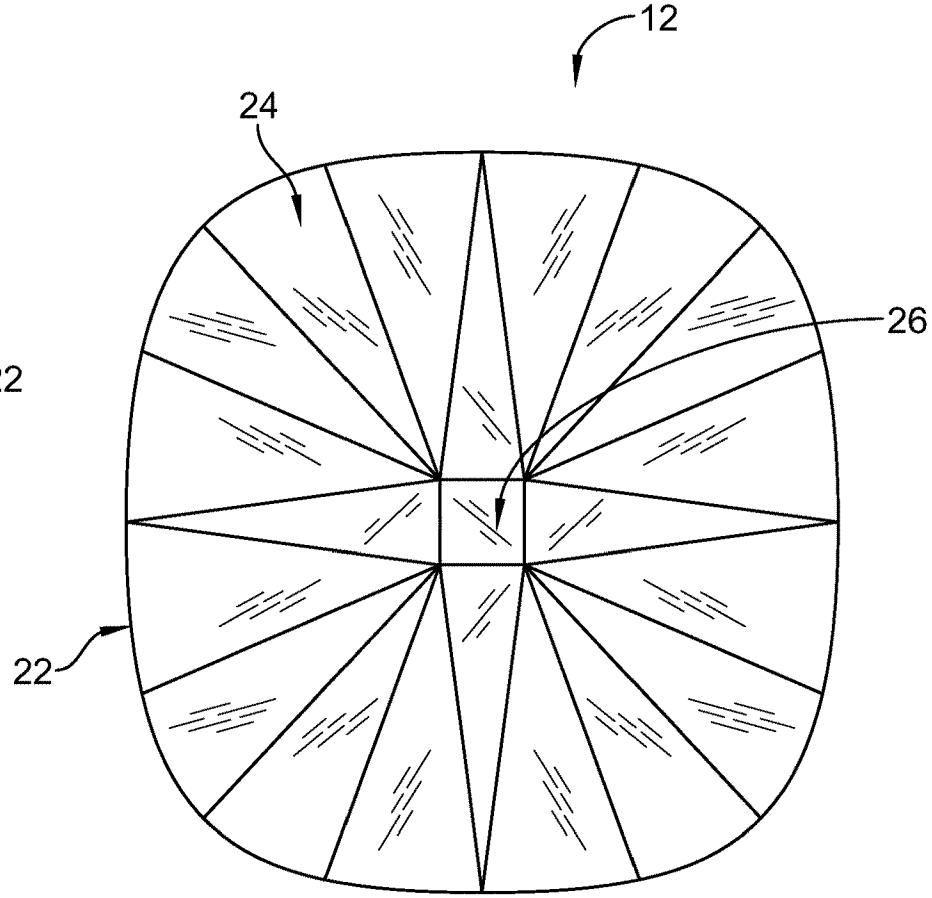
Figure 3:
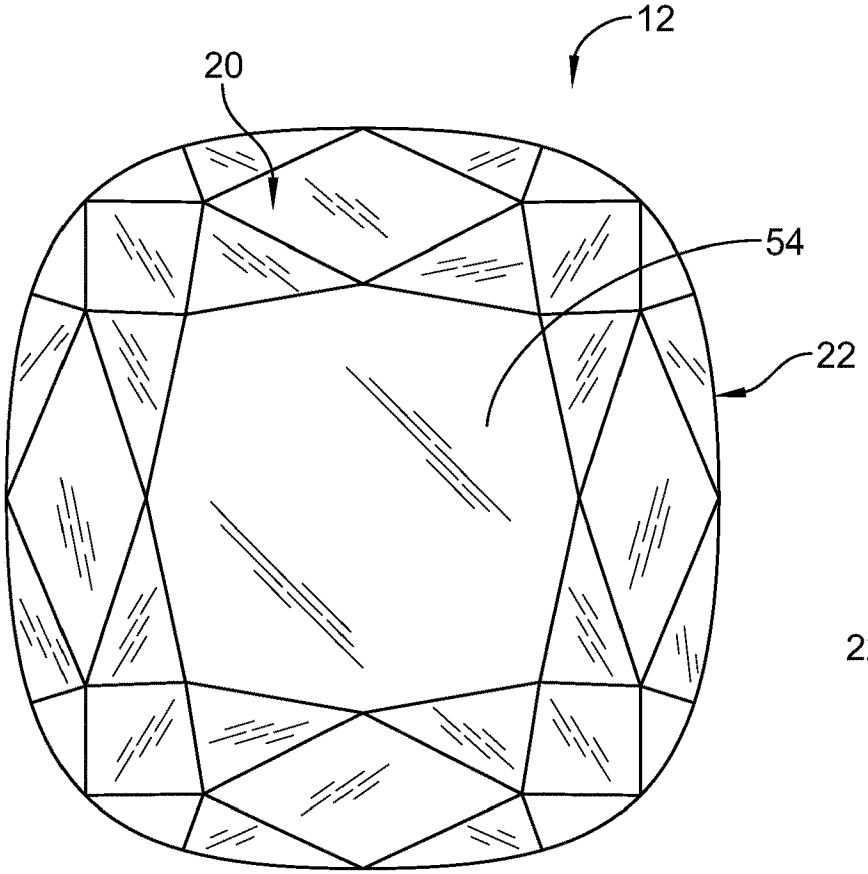
Figure 5:
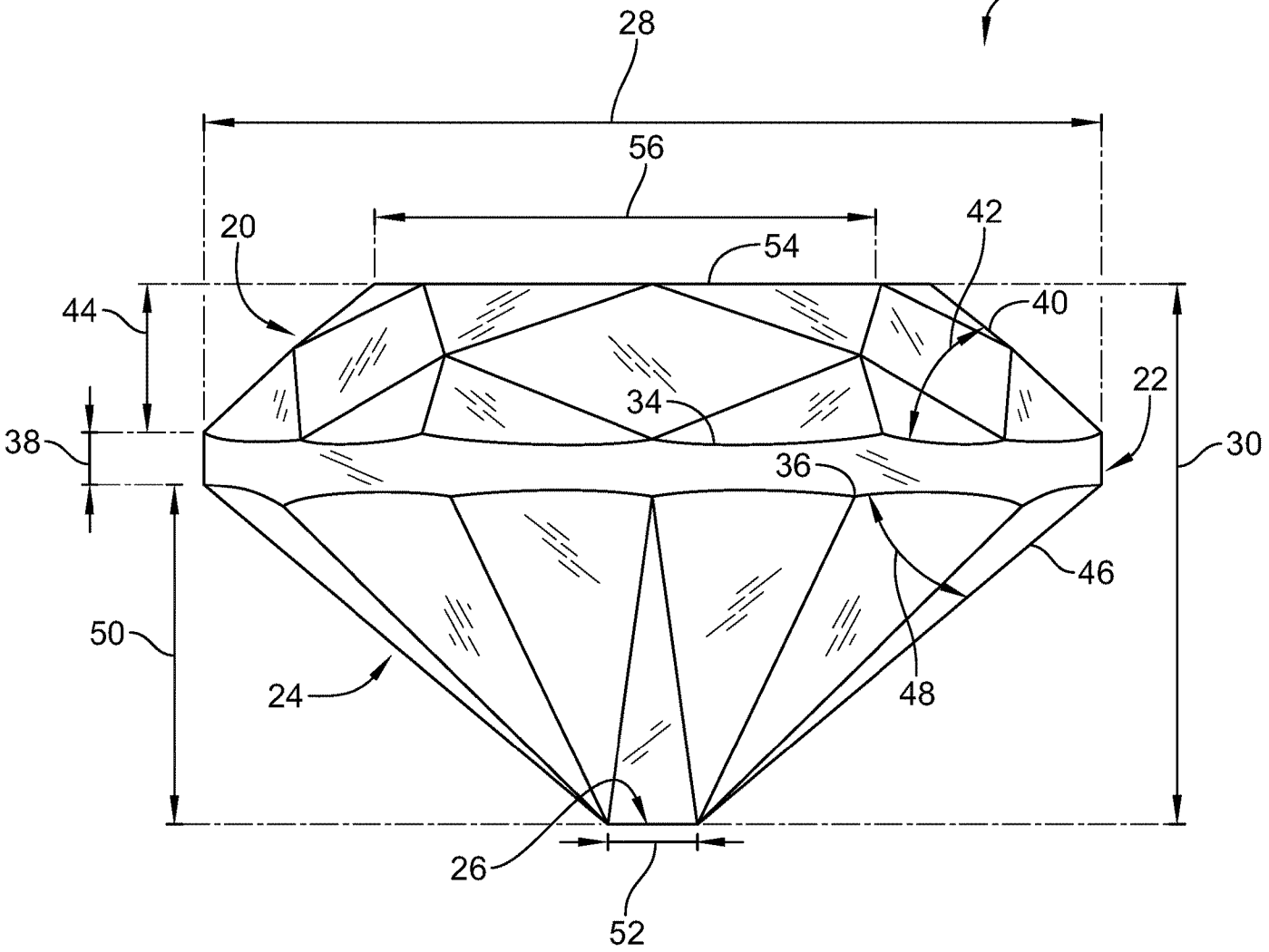
Figure 7:
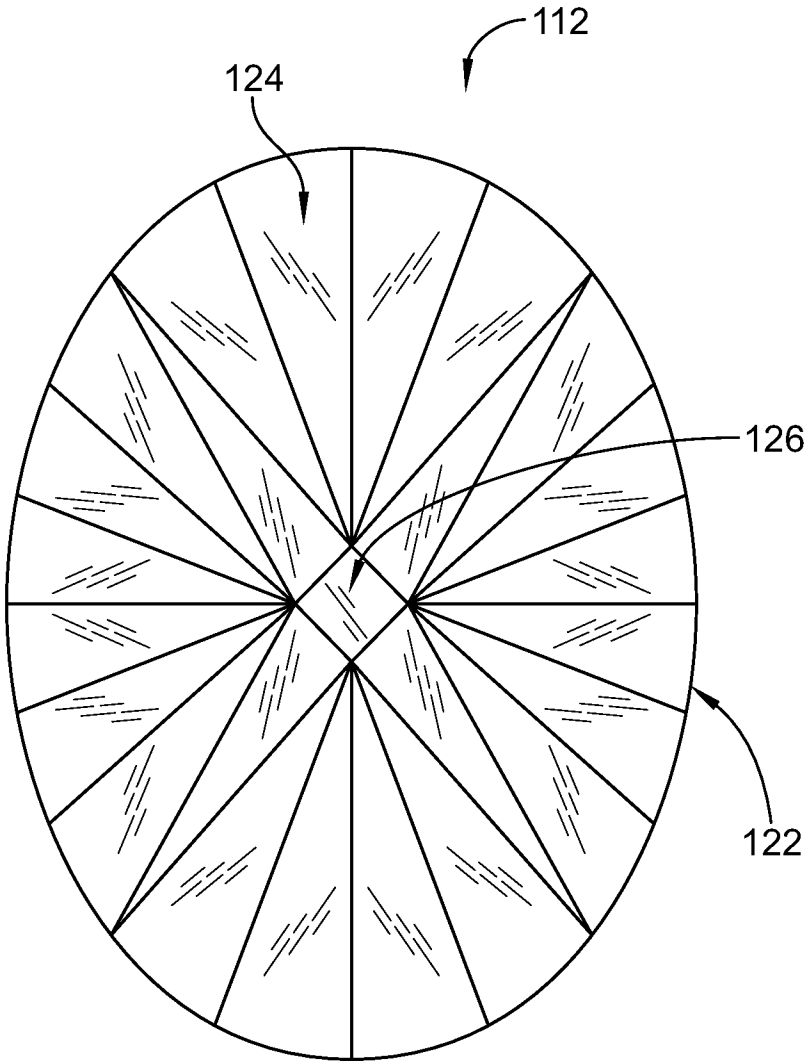
Figure 6:
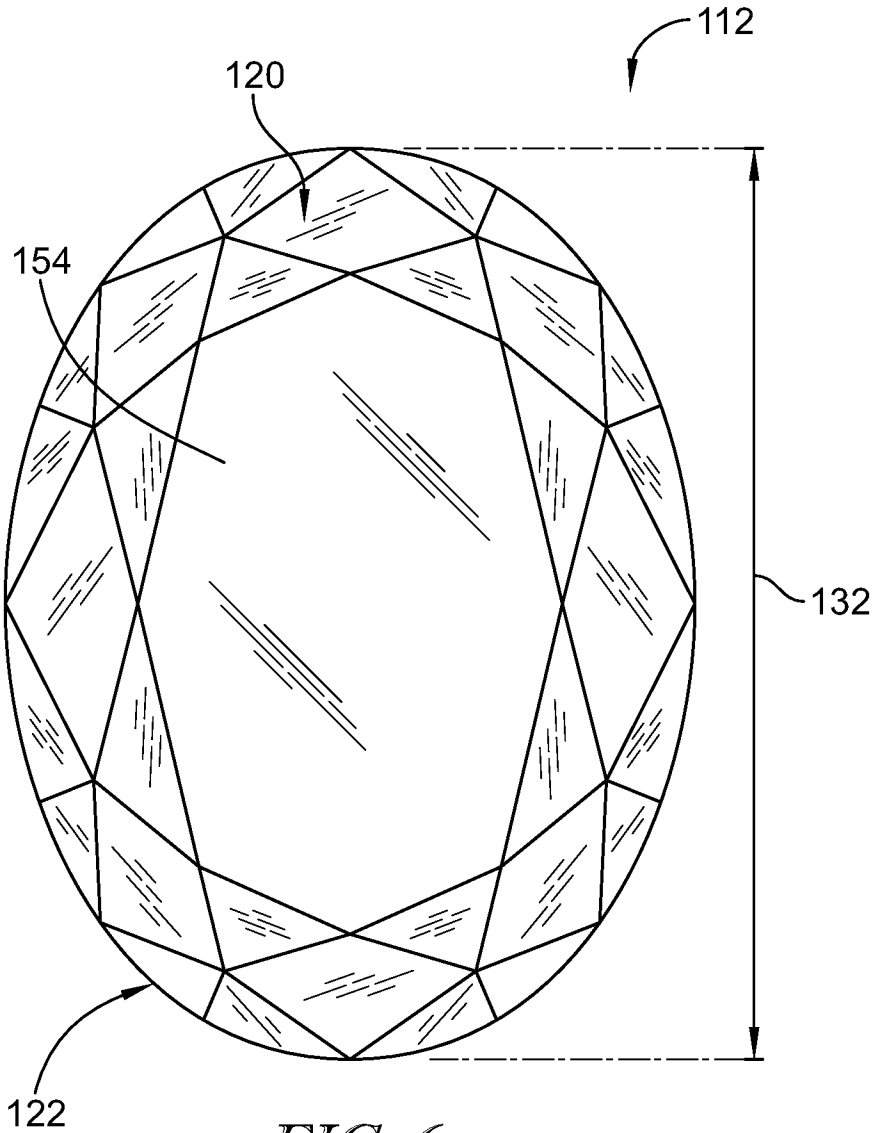
Figure 8:
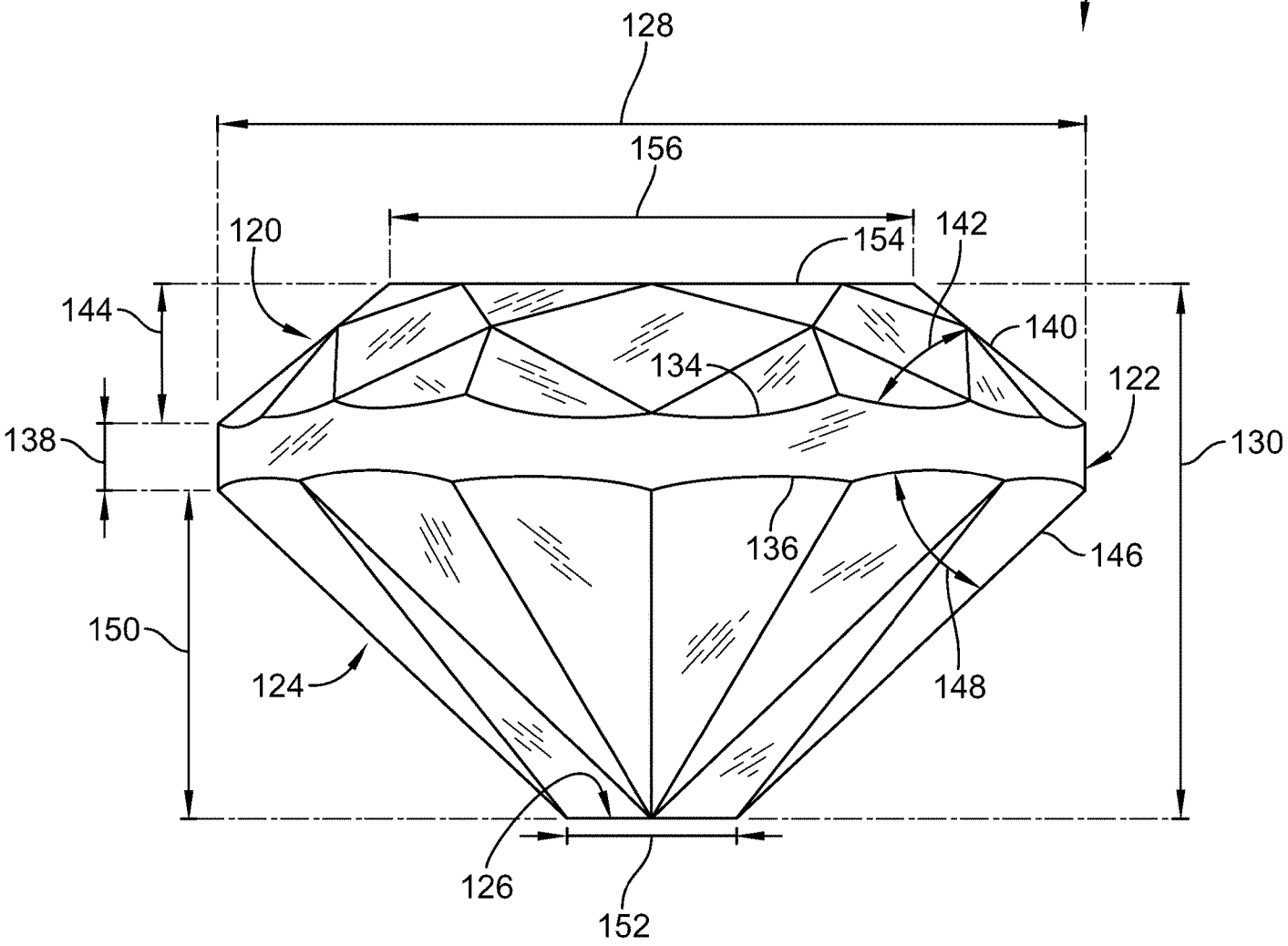
Figure 9:
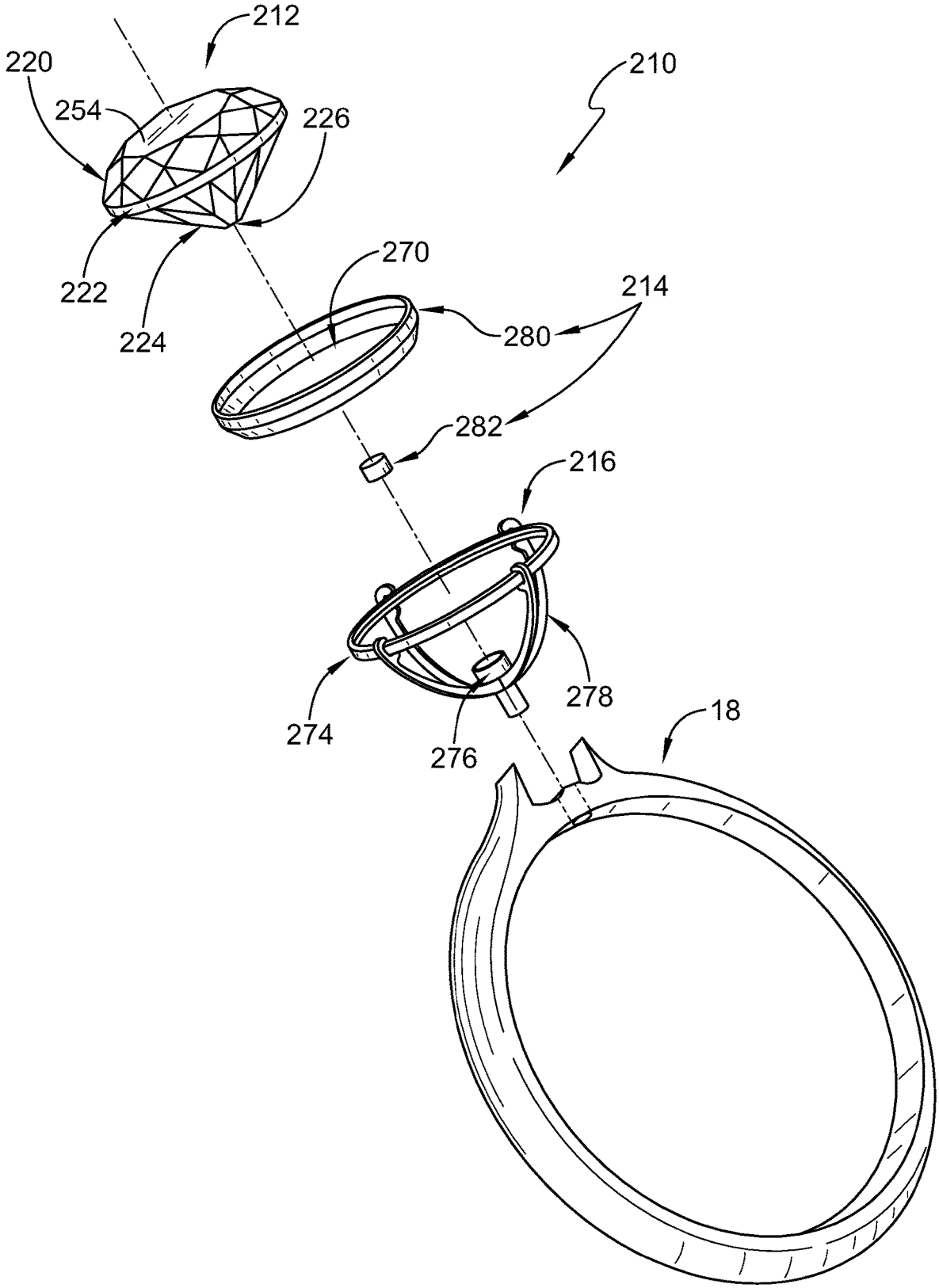
Figure 10:
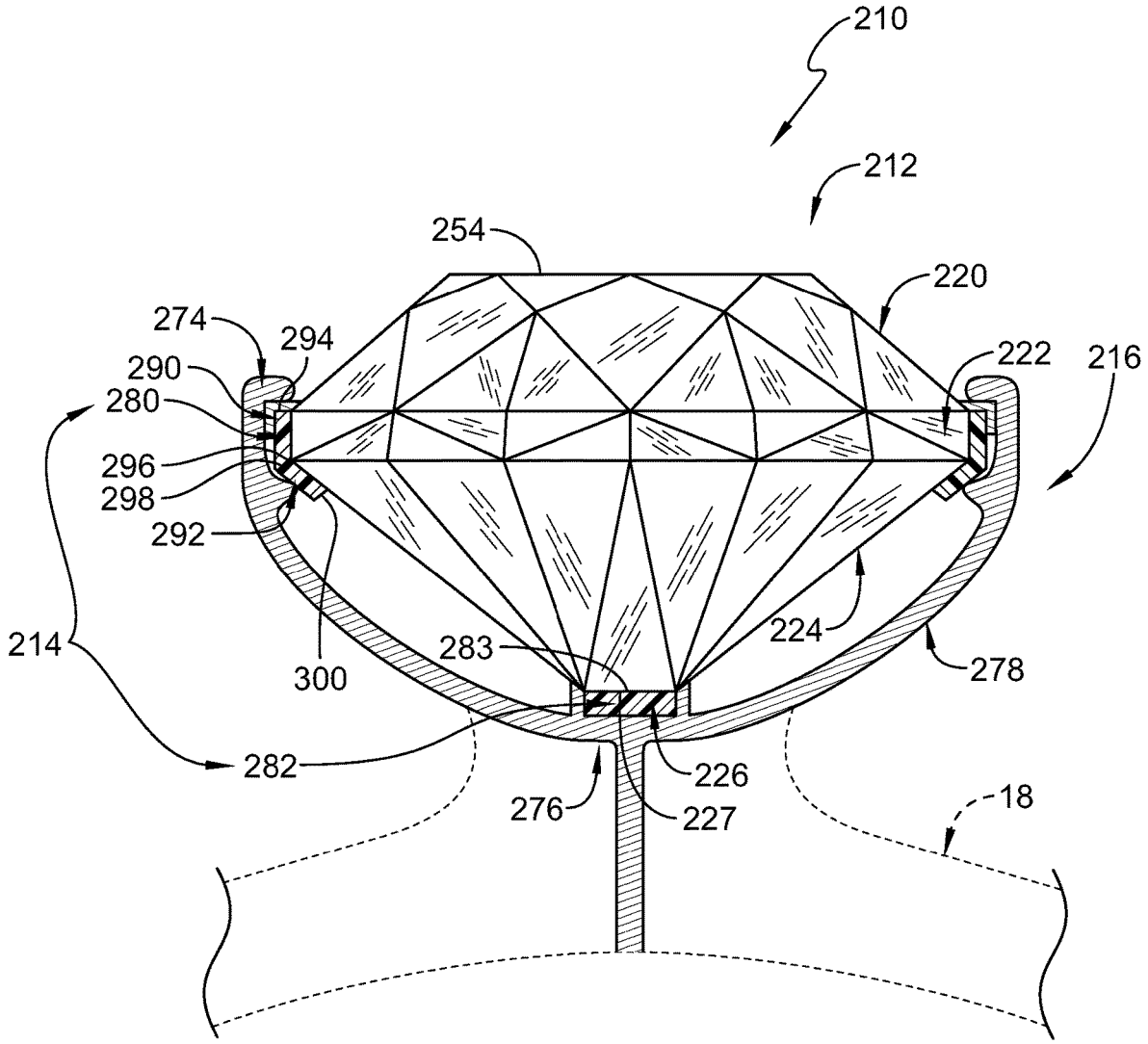
Figure 11:
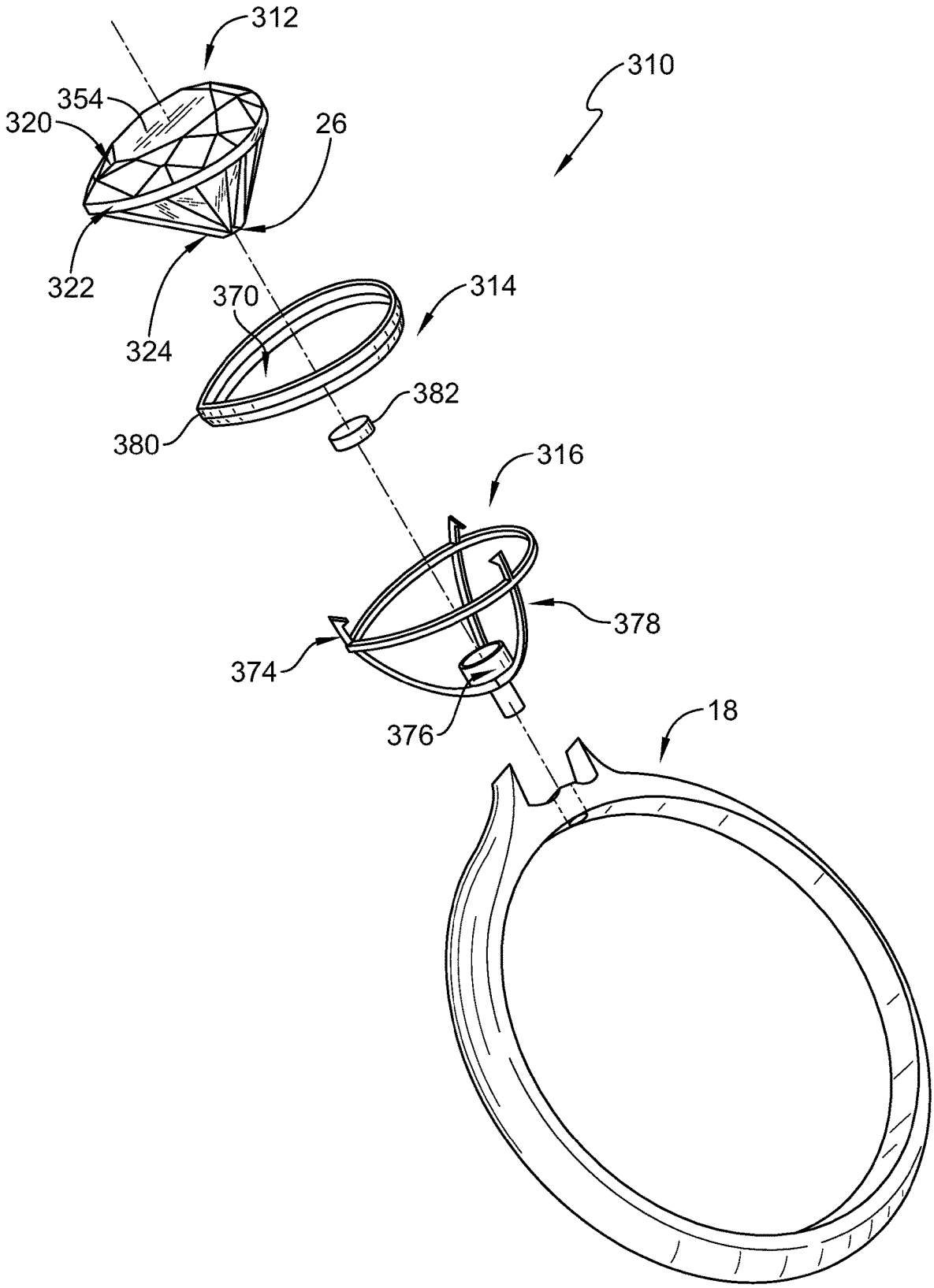
Figure 13:
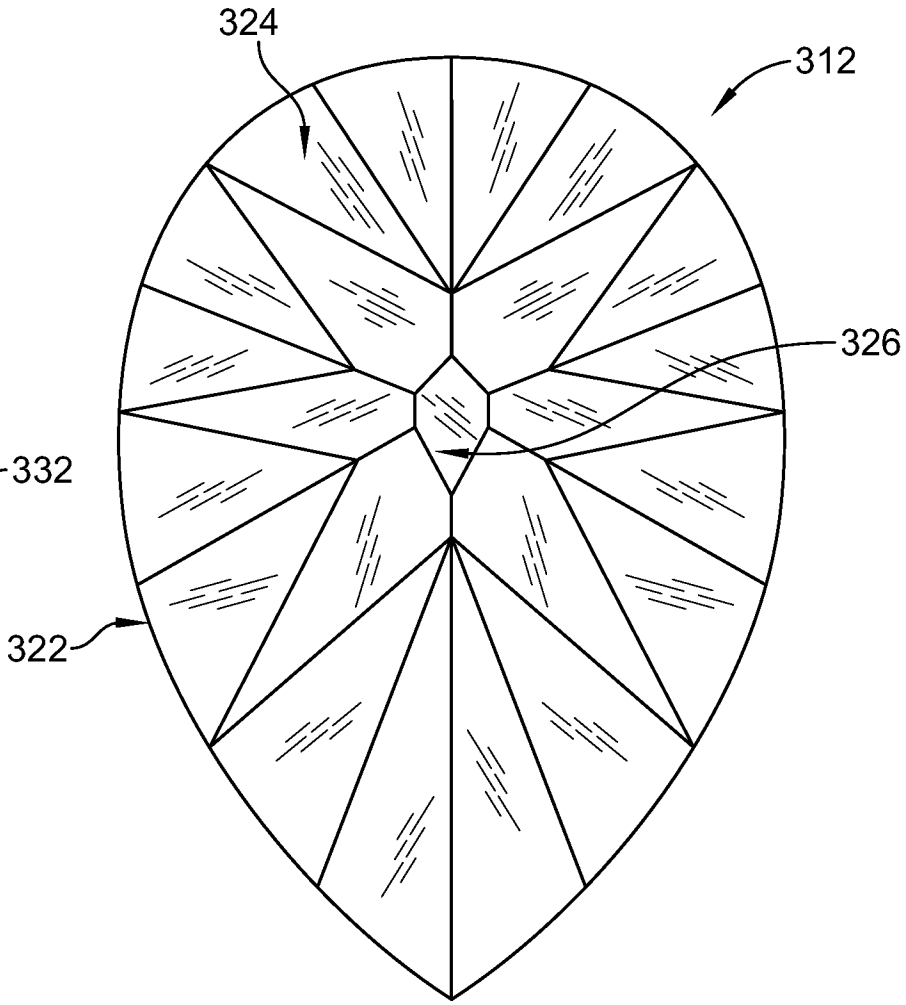
Figure 12:
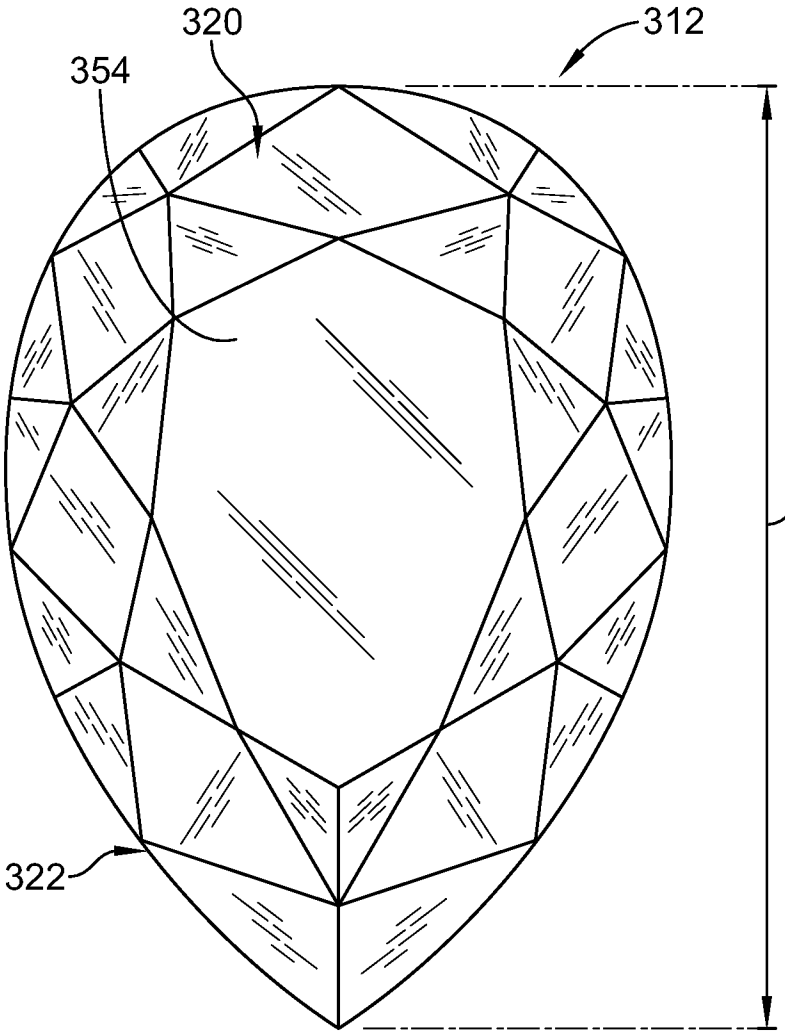
Figure 14:
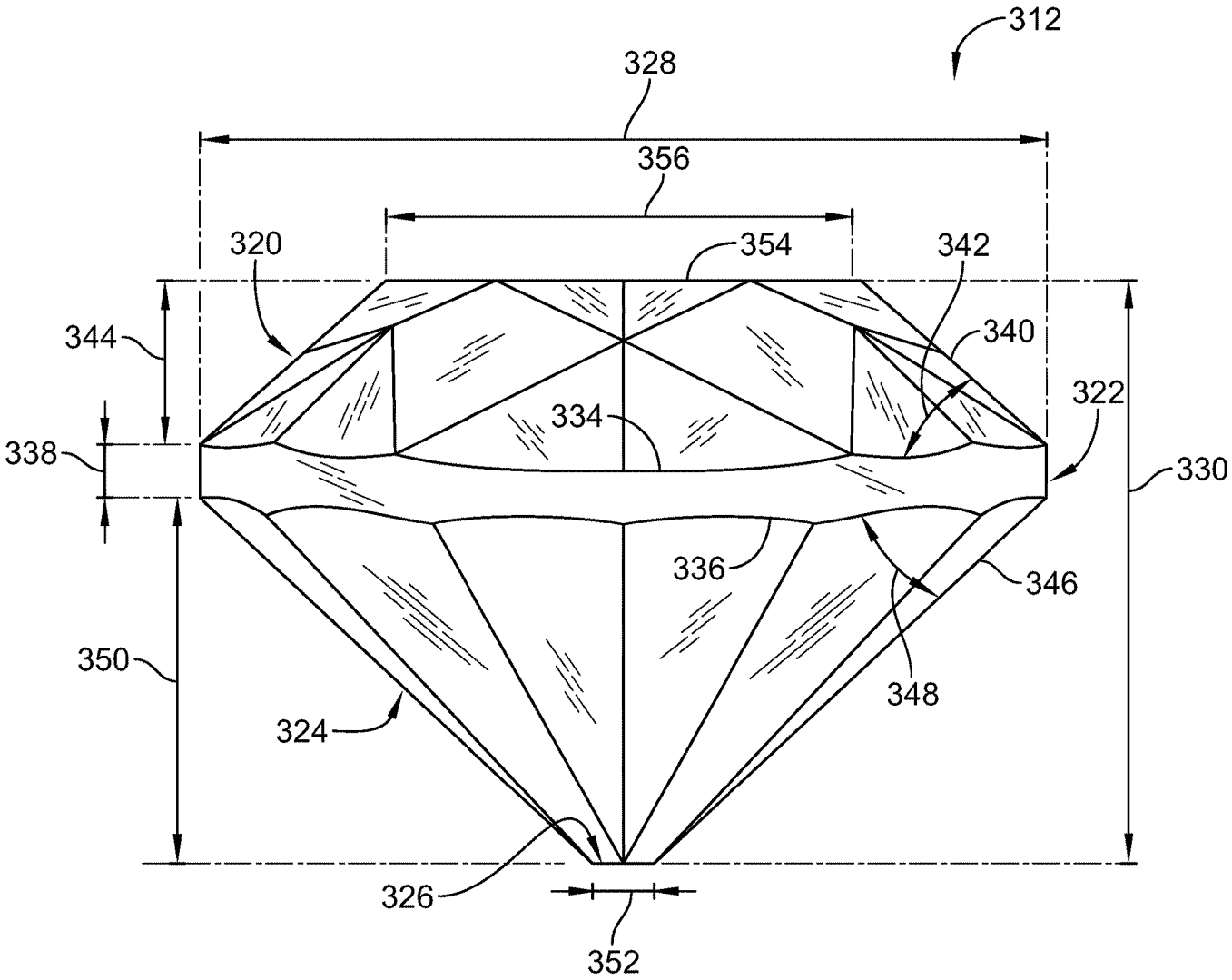

The detailed description particularly refers to the accompanying figures in which:

FIG. 1 is an exploded perspective view of a light-emitting jewelry piece in accordance with the present disclosure showing that the light-emitting jewelry piece includes, from top to bottom, a gemstone, a light-emission system arranged to receive the gemstone and to discharge light through the gemstone, a head arranged to support the gemstone and the light-emission system, and a mount arranged to secure the light-emitting jewelry piece to a person or personal adornment;

FIG. 2 is a diagrammatic and elevation view showing the gemstone of FIG. 1 spaced apart from the light-emission system, and further showing that the gemstone includes, from top to bottom, a crown, a relatively thick polished girdle, a pavilion, and a relatively large culet, and suggesting how UV light or ambient light emitted from a light source (e.g., sun light or electrical lighting) located above the gemstone enters the gemstone through the crown and is directed out of the gemstone through the pavilion where the light is captured by the light-emission system and emitted back into the gemstone over a period of time;

FIG. 3 is a top view of the gemstone of FIG. 1 showing that the gemstone is a cushion-cut gemstone cut to direct a first portion of light entering the gemstone through the crown and back up through the crown and the table and to direct a second portion of light entering the gemstone out of the gemstone toward the light-emission system to be captured by the light-emission system and emitted back up into and through the gemstone over a period of time;

FIG. 4 is a bottom view of the cushion-cut gemstone of FIG. 3 showing the relatively large culet of the gemstone and a plurality of facets of the pavilion;

FIG. 5 is an elevation view of the cushion-cut gemstone of FIG. 3 showing that the cushion-cut gemstone includes, from top to bottom, the crown including an outer crown surface having a crown angle defined between the outer crown surface and a top edge of the girdle, the relatively thick girdle having a top edge and a bottom edge spaced apart from the top edge, the pavilion including an outer pavilion surface having a pavilion angle defined between the outer pavilion surface and the bottom edge of the girdle, and the relatively large culet;

FIG. 6 is a top view of another gemstone in accordance with the present disclosure, the gemstone being an oval-cut gemstone cut to direct a first portion of light entering the gemstone through the table and the crown then back at the viewer and to direct a second portion of light entering the gemstone out of the gemstone toward the light-emission system to be captured by the light-emission system and emitted back into and back through the gemstone over a period of time;

FIG. 7 is a bottom view of the oval-cut gemstone of FIG. 6 showing the relatively large polished culet and a plurality of facets of the pavilion;

FIG. 8 is an elevation view of the oval-cut gemstone of FIG. 6 showing that the oval-cut gemstone includes, from top to bottom, the crown including an outer crown surface having a crown angle defined between the outer crown surface and a top edge of the girdle, the relatively thick polished girdle having a top edge and a bottom edge spaced apart from the top edge, the pavilion including an outer pavilion surface having a pavilion angle defined between the outer pavilion surface and the bottom edge of the girdle, and the relatively large culet;

FIG. 9 is an exploded perspective view of another embodiment of a light-emitting jewelry piece in accordance with the present disclosure showing that the light-emitting jewelry piece includes, from top to bottom, a gemstone, a light-emission system having a light-emitting band and a light-emitting disk configured to store and discharge light through the gemstone over time, a head arranged to support the gemstone and the light-emission system, and a mount arranged to secure the light-emitting jewelry piece to a person or personal adornment and further suggesting that the light-emitting band is configured to be positioned around the girdle of the gemstone with or without an airgap therebetween and the light-emitting disk is configured to mate with the culet of the gemstone;

FIG. 10 is a sectional and diagrammatic view of the light-emitting jewelry piece of FIG. 9 showing that the light-emission system includes the light-emitting band coupled to an external surface of the girdle of the gemstone and the light-emitting disk mated with the culet, the light-emitting band and the light-emitting disk configured to receive Ultra-Violet (UV) light or ambient light through the gemstone as suggested in FIG. 2 and store the UV light or ambient light for discharge through the gemstone over a period of time, and further showing that the head includes a gem retainer supporting the girdle of the gemstone, a culet retainer supporting the culet of the gemstone, and a plurality of prongs that extend between and interconnect the gem retainer and the culet support;

FIG. 11 is an exploded perspective view of another light-emitting jewelry piece in accordance with the present disclosure showing that the light-emitting jewelry piece includes, from top to bottom, a pear-cut gemstone, a light-emission system configured to be arranged around a portion of the pear-cut gemstone and to discharge light through the pear-cut gemstone, a head arranged to support the pear-cut gemstone and the light-emission system, and a mount arranged to secure the light-emitting jewelry piece to a person or personal adornment;

FIG. 12 is a top view of the pear-cut gemstone of FIG. 11 showing that the pear-cut gemstone is shaped to direct a first portion of light entering the gemstone through the crown and table then back at the viewer and to direct a second portion of light entering the gemstone out of the gemstone toward the light-emission system to be captured by the light-emission system and emitted back through the pear-cut gemstone over a period of time;

FIG. 13 is a bottom view of the pear-cut gemstone of FIG. 12 showing the relatively large polished culet of the gemstone and a plurality of facets of the pavilion; and FIG. 14 is an elevation view of the pear-cut gemstone of FIG. 12 showing that the pear-cut gemstone includes, from top to bottom, the crown including an outer crown surface having a crown angle defined between the outer crown surface and a top edge of the girdle, the relatively thick polished girdle having a top edge and a bottom edge spaced apart from the top edge, the pavilion including an outer pavilion surface having a pavilion angle defined between the outer pavilion surface and the bottom edge of the girdle, and the relatively large culet.

DETAILED DESCRIPTION

A light-emitting jewelry piece 10 in accordance with the present disclosure is shown in FIGS. 1-5. In the illustrative embodiment, the light-emitting jewelry piece 10 is a ring as shown in FIG. 1. Another embodiment of a light-emitting jewelry piece 110 in accordance with the present disclosure is shown in FIGS. 6-8. Another light-emitting jewelry piece 210 in accordance with the present disclosure is shown in FIGS. 9 and 10. Another light-emitting jewelry piece 310 in accordance with the present disclosure is shown in FIGS. 11-14.

The light-emitting jewelry piece 10 includes a gemstone 12, a light-emission system 14, a head 16, and a mounting 18 as shown in FIG. 1. The gemstone 12 is a piece of material used to make an adornment such as, for example, a mineral, metal, rock, plastic, glass, colored gemstone, whether precious or non-precious, natural diamond, and lab-created diamond. The light-emission system 14 provides means for emitting light over time in response to receiving and storing energy 72 (e.g., UV light or ambient light) to cause visible light to be emitted through the gemstone 12. By emitting visible light over time, the light-emission system 14 illuminates the gemstone 12. Notably, the light-emission system 14 illuminates the gemstone 12 over time to allow a person to view the gemstone 12. Viewing may be maximized when the light-emitting jewelry piece 10 is in dusk and/or a dark environment. The head 16 interconnects the gemstone 12 to the mounting 18. The mounting 18 secures the light-emitting jewelry piece 10 to a person or a personal adornment. In other embodiments, the light-emitting jewelry piece 10 may be a pendant, bracelet, earrings, broach, or pin.

Illustratively, the gemstone 12 is a cushion-cut diamond as shown in FIGS. 1-5. The gemstone 12 includes a crown 20, a girdle 22, a pavilion 24, and a culet 26 as shown in FIGS. 1, 2, and 5. The crown 20 is located in spaced-apart relation above the pavilion 24 to locate the girdle 22 therebetween as shown in FIG. 5. The pavilion 24 is located between the girdle 22 and the culet 26. The culet 26 is a generally flat face (sometimes called a facet) on a bottom of the gemstone 12 as shown in FIGS. 4 and 5.

In the illustrative embodiment, the light-emission system 14 includes a light-emitting shell 60 as shown in FIGS. 1 and 2. The light-emitting shell 60 emits visible light through the gemstone 12 to illuminate the gemstone 12 in response to receiving and storing energy 72 (e.g., UV light or ambient light). As such, the gemstone 12 is illuminated by the light-emitting shell 60 until the stored energy 72 is depleted and, as a result, the gemstone 12 is illuminated and viewable in dusk and dark environments.

In operation, the light-emitting shell 60 and the gemstone 12 cooperate to capture light from light sources as suggested in FIG. 2. For example, the light-emitting shell 60 and the gemstone 12 cooperate to capture light from an upper light source 80 located above the crown 20 of the gemstone 12 as shown FIG. 2. The gemstone 12 is cut so that light transmitted through the crown 20 is communicated through the girdle 22, the pavilion 24, and the culet 26 to the light-emitting shell 60. As light 72 or other radiation enters the gemstone 12, a first portion of the light 72 is communicated back through the gemstone 12 to give the gemstone 12 brilliance and a second portion of the light 72 is communicated to the light-emitting shell 60 to charge the light-emitting shell 60.

The light 72 continuously charges the light-emitting shell 60 as suggested in FIG. 2. The light-emitting shell 60 continuously emits a portion of the stored light 72. The light-emitting shell 60 visually emits the stored light 72 through the gemstone's pavilion 24, girdle 22, and culet 26, and out of the table 54 and the crown 20 over time. As such, the gemstone 12 is illuminated by the light-emitting shell 60. Once ambient light decreases, such as after sun down or in a darkened room, the visually emitted light 72 may become more apparent to an observer.

The gemstone 12 may be one of a variety of sizes. In some embodiments, the gemstone 12 may range from a diameter of about 3.0 millimeters up to any diameter gemstone. In the illustrative embodiment, the gemstone 12 is about 0.65 carats in weight. Illustratively, the gemstone 12 has a width 28 and a height 30 as shown in FIG. 5. The width 28 of the illustrative gemstone 12 is 5.1 millimeters. The height 30 of the illustrative gemstone 12 is 3.15 millimeters. Dimensions of the gemstone 12 may be expressed by percentages of the width 28 of the gemstone 12. As an example, the height 30 of the illustrative gemstone 12 is 61.8 percent of the width 28 of the gemstone 12. As such, the illustrative gemstone 12 may be said to have a height 30 of 61.8 percent.

The girdle 22 defines the width 28 of the gemstone 12 as suggested in FIG. 5. In the illustrative embodiment, the girdle 22 has a width of about 5.1 millimeters. In other embodiments, the gemstone 12 may have a diameter of about 4.0 millimeters with a weight of about 0.25 carats, a diameter of about 4.4 millimeters with a weight of about 0.33 carats, a diameter of about 5.8 millimeters with a weight of about 0.75 carats, and a diameter of about 6.3 millimeters with a weight of about 1.0 carat for a round cut gemstone. The illustrative girdle 22 is highly polished. The girdle 22 is configured to mate with a shoulder support 64 of the light-emission system 14 as suggested in FIG. 2.

The girdle 22 includes a top edge 34 and a bottom edge 36 spaced apart from the top edge 34 as shown in FIG. 5. In the illustrative embodiment, the bottom edge 36 is spaced apart from the top edge 34 by a generally consistent distance around the circumference of the gemstone 12 to define a girdle height 38 as shown in FIG. 5. In some embodiments, the bottom edge 36 is spaced apart from the top edge 34 by a first distance in primary portions of the girdle 22 and by a second distance in secondary portions of the girdle 22. Each primary portion is positioned circumferentially between a pair of secondary portions. The first distance is greater than the second distance.

The girdle 22 has the relatively large girdle height 38 to increase a surface area engagement between the gemstone 12 and the shoulder support 64 of the light-emission system 14. In one example, the girdle height 38 is in a range of about or specifically 2 percent and about or specifically 15 percent of the width 28. In another example, the girdle height 38 is in a range of about or specifically 4 percent and about or specifically 8 percent of the width 28. In another example, the girdle height 38 is in a range of about or specifically 4.5 percent and about or specifically 8.5 percent of the width 28. In another example, the girdle height 38 is in a range of about or specifically 5 percent and about or specifically 7 percent of the width 28. In another example, the girdle height 38 is in a range of about or specifically 5.5 percent and about or specifically 7.5 percent of the width 28. In another example, the girdle height 38 is about or specifically 6.5 percent of the width 28. In another example, the girdle height 38 is about or specifically 6 percent of the width 28. In another example, the girdle height 38 is about or specifically 5.5 percent of the width 28. In the illustrative embodiment, the girdle height 38 is 6.2 percent of the width 28. In the illustrative embodiment, the girdle height 38 is 0.32 millimeters.

In some embodiments, the girdle 22 has a relatively large girdle height 38 when compared to an ideal cut diamond such as American Standard cut or the Tolkowsky Brilliant cut. The relatively large girdle height 38 may be about 10 percent to about 15 percent larger than an ideal cut diamond. In embodiments that include primary and secondary portions, the primary portions and the secondary portions may be about 10 percent to about 15 percent larger than the primary and secondary portions of an ideal cut diamond respectively.

The crown 20 extends from the girdle 22 away from the pavilion 24 as shown in FIG. 5. An outer crown surface 40 of the crown 20 and the top edge 34 of the girdle 22 define a crown angle 42 as shown in FIG. 5. Sometimes, the crown angle 42 may be referred to as being defined between facets of the crown 20 and a girdle plane. The crown angle 42 may also be referred to as being defined by a leading edge of the table 54 and a top leading edge of the girdle 22. In one example, the crown angle 42 is in a range of about or specifically 36 degrees to about or specifically 50 degrees. In another example, the crown angle 42 is in a range of about or specifically 39 degrees to about or specifically 46 degrees. In another example, the crown angle 42 is in a range of about or specifically 39 degrees to about or specifically 45 degrees. In another example, the crown angle 42 is in a range of about or specifically 39 degrees to about or specifically 44 degrees. In another example, the crown angle 42 is in a range of about or specifically 40 degrees to about or specifically 46 degrees. In another example, the crown angle 42 is in a range of about or specifically 41 degrees to about or specifically 46 degrees. In another example, the crown angle 42 is in a range of about or specifically 44 degrees to about or specifically 46 degrees. In another example, the crown angle 42 is in a range of about or specifically 45 degrees to about or specifically 46 degrees.

In another example, the crown angle 42 is in a range of about or specifically 36 degrees to about or specifically 45 degrees. In another example, the crown angle 42 is in a range of about or specifically 38 degrees to about or specifically 42 degrees. In another example, the crown angle 42 is in a range of about or specifically 39 degrees to about or specifically 41 degrees. In another example, the crown angle 42 is about or specifically 40 degrees. In the illustrative embodiment, the crown angle 42 is 39.5 degrees.

The crown 20 includes a crown height 44 defined between a table 54 of the gemstone 12 and the top edge 34 of the girdle 22 as shown in FIG. 5. In one example, the crown height 44 is in a range of about or specifically 16 percent and about or specifically 20 percent of the width 28 of the gemstone 12. In another example, the crown height 44 is in a range of about or specifically 17 percent and about or specifically 19 percent of the width 28. In another example, the crown height 44 is about or specifically 18 percent of the width 28. In another example, the crown height 44 is about or specifically 16 percent of the width 28. In the illustrative embodiment, the crown height 44 is 17.8 percent of the width 28. In the illustrative embodiment, the crown height 44 is 0.91 millimeters.

In another example, the crown height 44 is in a range of about or specifically 15 percent and about or specifically 19 percent of the width 28. In another example, the crown height 44 is in a range of about or specifically 16 percent and about or specifically 18 percent of the width 28.

The pavilion 24 extends between and interconnects the girdle 22 and the culet 26 as shown in FIG. 5. The pavilion 24 includes a plurality of outer pavilion surfaces 46 (sometimes called facets) that extend between and interconnect the girdle 22 and the culet 26. A pavilion angle 48 is defined between each outer pavilion surface 32 of the pavilion 24 and the bottom edge 36 of the girdle 22 as shown in FIG. 5.

In one example, the pavilion angle 48 is in a range of about or specifically 36 degrees to about or specifically 50 degrees. In another example, the pavilion angle 48 is in a range of about or specifically 39 degrees to about or specifically 45 degrees. In another example, the pavilion angle 48 is in a range of about or specifically 40 degrees to about or specifically 45 degrees. In another example, the pavilion angle 48 is in a range of about or specifically 41 degrees to about or specifically 45 degrees. In another example, the pavilion angle 48 is in a range of about or specifically 42 degrees to about or specifically 45 degrees. In another example, the pavilion angle 48 is in a range of about or specifically 43 degrees to about or specifically 45 degrees.

In another example, the pavilion angle 48 is in a range of about or specifically 39 degrees to about or specifically 44 degrees. In another example, the pavilion angle 48 is in a range of about or specifically 39 degrees to about or specifically 43 degrees. In another example, the pavilion angle 48 is in a range of about or specifically 39 degrees to about or specifically 42 degrees. In another example, the pavilion angle 48 is in a range of about or specifically 39 degrees to about or specifically 40 degrees.

In another example, the pavilion angle 48 is in a range of about or specifically 36 degrees to about or specifically 45 degrees. In another example, the pavilion angle 48 is in a range of about or specifically 38 degrees to about or specifically 42 degrees. In another example, the pavilion angle 48 is in a range of about or specifically 39 degrees to about or specifically 41 degrees. In another example, the pavilion angle 48 is about or specifically 40 degrees. In the illustrative embodiment, the pavilion angle 48 is 39.7 degrees.

The pavilion 24 includes a pavilion depth 50 defined between the bottom edge 36 of the girdle 22 and the culet 26 as shown in FIG. 5. In one example, the pavilion depth 50 is in a range of about or specifically 36 percent and about or specifically 40 percent of the width 28. In another example, the pavilion depth 50 is in a range of about or specifically 37 percent and about or specifically 39 percent of the width 28. In another example, the pavilion depth 50 is about or specifically 38.5 percent of the width 28. In another example, the pavilion depth 50 is about or specifically 38 percent of the width 28. In the illustrative embodiment, the pavilion depth 50 is 37.5 percent of the width 28. In the illustrative embodiment, the pavilion depth 50 is 1.91 millimeters.

In another example, the pavilion depth 50 is in a range of about or specifically 37 percent and about or specifically 41 percent of the width 28. In another example, the pavilion depth 50 is in a range of about or specifically 38 percent and about or specifically 40 percent of the width 28.

The culet 26 is configured to mate with the light-emission system 14 as suggested in FIG. 2. The culet 26 is relatively oversized to increase a surface area engagement between the gemstone 12 and the light-emission system 14 for greater light absorption from the light-emission system 14 into the gemstone 12. In some embodiments, the culet 26 mates with a culet cover 66 included in the light-emission system 14 as suggested in FIG. 2. In other embodiments, the culet 26 mates with a light-emitting disk 282 included in a light-emission system 214 as suggested in FIGS. 9 and 10.

The culet 26 includes a culet width 52 (sometimes called a culet diameter) as shown in FIG. 5. In one example, the culet width 52 is in a range of about or specifically 7.5 percent and about or specifically 22 percent of the width 28 of the gemstone 12. In another example, the culet width 52 is in a range of about or specifically 9 percent and about or specifically 13 percent of the width 28. In another example, the culet width 52 is in a range of about or specifically 10 percent and about or specifically 12 percent of the width 28. In another example, the culet width 52 is about or specifically 11 percent of the width 28. In another example, the culet width 52 is 11.8 percent of the width 28. In the illustrative embodiment, the culet width 52 is 0.60 millimeters.

In another example, the culet width 52 is in a range of about or specifically 18 percent and about or specifically 22 percent of the width 28. In another example, the culet width 52 is in a range of about or specifically 19 percent and about or specifically 20 percent of the width 28. In another example, the culet width 52 is about or specifically 20 percent of the width 28. In another example, the culet width 52 is about or specifically 18 percent of the width 28.

The culet 26 may be, for example, oversized when compared to an ideal cut diamond such as the American Standard cut or the Tolkowsky Brilliant cut. The culet 26 may be about 10 percent to about 15 percent larger than a culet of an ideal cut diamond. In some embodiments, the culet 26 is about 13 percent larger than a culet of an ideal cut diamond. In the illustrative embodiment, the culet 26 is off-center. Illustratively, the culet 26 is off-center by 1.8 percent. The culet 26 may also be highly polished.

The gemstone 12 further includes a table 54 including a table width 56 as shown in FIG. 5. In one example, the table width 56 is in a range of about or specifically 45 percent and about or specifically 65 percent of the width 28 of the gemstone 12. In another example, the table width 56 is in a range of about or specifically 50 percent and about or specifically 60 percent of the width 28. In another example, the table width 56 is in a range of about or specifically 51.5 percent and about or specifically 59 percent of the width 28. In another example, the table width 56 is in a range of about or specifically 54 percent and about or specifically 56.5 percent of the width 28. In another example, the table width 56 is about or specifically 55 percent of the width 28. In another example, the table width 56 is 61 percent of the width 28. In the illustrative embodiment, the table width 56 is 56.2 percent of the width 28. In the illustrative embodiment, the table width 56 is 2.87 millimeters. The illustrative table 54 is off-center by 0.12 millimeters.

The light-emission system 14 emits light over a period of time to illuminate the gemstone 12 as shown in FIG. 2. In one example, the light-emission system 14 may emit a green light. In another example, the light-emission system 14 may emit a blue light. In still yet another example, the light-emission system 14 may emit any other suitable color of light. In other embodiments, the light-emission system 14 emits a plurality of colors of light.

Illustratively, the light-emitting shell 60 is made from a photo-luminescent material. In some embodiments, the light-emitting shell 60 includes plastics material. In some embodiments, the light-emitting shell 60 includes photo-luminescent material and plastics materials. The light-emitting shell 60 may be rotocast or injection molded from the photo-luminescent material. In one example, the photo-luminescent material includes phosphorous material and poly-vinyl chloride. In another example, the photo-luminescent material includes phosphorous material and an acrylic material. In another example, the photo-luminescent material may include a phosphorous material, poly-vinyl chloride, an acrylic material, mixtures thereof, or any other suitable alternative. In the illustrative embodiment, the light-emitting shell 60 has a thickness of about 0.5 millimeters.

The light-emitting shell 60 is coupled to the head 16 in a fixed position as suggested in FIG. 1. The light-emitting shell 60 is configured to couple to the gemstone 12 in such a way as to minimize space between the gemstone 12 and the light-emitting shell 60 so that ingress of debris such as, for example, moisture, dirt, or condensation build up between the gemstone 12 and the light-emitting shell 60 is minimized. In the illustrative embodiment, the light-emitting shell 60 is coupled to external surfaces of the gemstone 12.

Space between the gemstone 12 and the light-emitting shell 60 may be minimized through one or more manufacturing techniques. In one example, the light-emitting shell 60 is injection molded. In this example, the gemstone 12 is coupled to a portion of the mold using releasable sealant. During injection molding, molten plastics materials flow around the gemstone 12 into the mold chamber formed between the gemstone 12 and the mold. As a result, space between the gemstone 12 and the light-emitting shell 60 is minimized and the exact angle of the gemstone 12 in relation to the light-emitting shell 60 is provided. The gemstone 12 may be removed from the mold using a release pin which pushes the gemstone 12 away from the mold after molding. In addition, a gasket may be located between the girdle 22 of the gemstone 12 and the mold to minimize flashing of plastic material around the crown 20 of the gemstone 12.

The light-emitting shell 60 includes a body 62, the shoulder support 64, and the culet cover 66 as shown in FIG. 2. The body 62 engages the pavilion 24 to absorb and emit light through the gemstone 12. The shoulder support 64 engages the girdle 22 and couples the girdle 22 with the head 16. The culet cover 66 engages the culet 26 and couples the gemstone 12 with the head 16.

The body 62 is formed from a plurality of sidewalls 68. The sidewalls 68 are about parallel with the outer pavilion surfaces 32 included in the pavilion 24 of the gemstone 12. The sidewalls 68 engage with and mate with the pavilion 24 of the gemstone 12. Illustratively, the sidewalls 68 have a thickness of about 0.5 millimeters.

The plurality of sidewalls 68 cooperate to form a gemstone-receiver aperture 70 that extends into the light-emitting shell 60. The gemstone 12 is received in the gemstone-receiver aperture 70 to cause the sidewalls 68 of the body 62 to engage the outer pavilion surfaces 32 of the pavilion 24. In the illustrative embodiment, a sealant is located between the gemstone 12 and the body 62 to couple together external surfaces of the gemstone 12 and the body 62. The sealant blocks debris from entering the gemstone-receiver aperture 70 between the gemstone 12 and the body 62.

The shoulder support 64 extends radially outward from the body 62 away from the gemstone 12 as shown in FIG. 2. The shoulder support 64 extends around the body 62 circumferentially. The shoulder support 64 engages the girdle 22 of the gemstone 12 to couple the light-emitting shell 60 with the gemstone 12. In the illustrative embodiment, the shoulder support 64 has a thickness that is about equal to the thickness of the girdle 22. As such, the shoulder support 64 extends upwardly away from the body 62 to the top edge 34 of the girdle 22. In other embodiments, the shoulder support 64 has a thickness that is less than the thickness of the girdle 22. As a result, the shoulder support 64 may have an inverted L-shape.

The culet cover 66 extends downwardly from the body 62 away from the gemstone 12 as shown in FIGS. 1 and 2. The culet cover 66 is positioned between the head 16 and the culet 26 to support the gemstone 12. The culet cover 66 is received in a space formed in the head 16 to block movement of the light-emitting shell 60 away from the head 16. If the light-emitting jewelry piece 10 collides with a hard surface, the culet cover 66 blocks the head 16 from striking the culet 26 directly.

The head 16 includes a gem retainer 74, a culet support 76, and a plurality of prongs 78 as shown in FIG. 1. The gem retainer 74 mates with the girdle 22 of the gemstone 12 and the shoulder support 64 of the light-emitting shell 60 to retain the light-emitting shell 60 between the gemstone 12 and the head 16. The culet support 76 is located in spaced-apart relation to the gem retainer 74 and mates with the culet 26 of the gemstone 12 and retains the culet cover 66 of the light-emitting shell 60 between the gemstone 12 and the head 16. The prongs 78 extend between and interconnect the gem retainer 74 and the culet support 76.

In some embodiments, the light-emission system 14 includes at least one light source powered through radioluminescence. In some embodiments, the at least one light source is powered by tritium-illumination. In some embodiments, the light-emitting jewelry piece 10 is called a jewelry piece 10. In some embodiments, the light emission systems 114, 214, and 314 include at least one light source powered through radioluminescense.

Reference is hereby made to U.S. patent application Ser. No. 14/487,969 filed Sep. 16, 2014 and entitled LIGHT EMITTING JEWELRY for disclosure relating to gemstones, light-emission systems, and heads, which application is hereby incorporated in its entirety herein.

Another light-emitting jewelry piece 110 in accordance with the present disclosure is shown in FIGS. 6-8. The light-emitting jewelry piece 110 includes a gemstone 112, the light-emission system 14, the head 16, and the mounting 18. The gemstone 112 is a piece of material used to make an adornment such as, for example, a mineral, metal, rock, plastic, glass, colored gemstone, whether precious or non-precious, natural diamond, and lab-created diamond. The light-emission system 14 is configured to receive an oval-cut gemstone and is configured to provide means for emitting light over time to cause visible light to be emitted through the gemstone 12 and to be viewed by a person when the light-emitting jewelry piece 110 is in a dusk to dark environment. The head 16 interconnects the gemstone 112 to the mounting 18. The mounting 18 secures the light-emitting jewelry piece 110 to a person or a personal adornment.

Illustratively, the gemstone 112 is an oval-cut diamond as shown in FIGS. 6 and 7. The gemstone 112 includes a crown 120, a girdle 122, a pavilion 124, and a culet 126 as shown in FIG. 8.

Illustratively, the gemstone 112 has a width 128, a length 132, and a height 130 as shown in FIGS. 6 and 8. The width 128 of the illustrative gemstone 112 is 4.96 millimeters and the length 132 is 6.47 millimeters. The height 130 of the illustrative gemstone 112 is 3.06 millimeters. Dimensions of the gemstone 112 may be expressed by percentages of the width 128 of the gemstone 112. As an example, the height 130 of the illustrative gemstone 112 is 61.7 percent of the width 128 of the gemstone 112. As such, the illustrative gemstone 112 may be said to have a height 130 of 61.7 percent. In the illustrative embodiment, the gemstone 112 is about 0.74 carats in weight.

The oval-cut gemstone 112 includes a length-to-width ratio as suggested in FIG. 6. In one example, the length-to-width ratio is between about 1.0 and about 1.5. In the illustrative embodiment, the length-to-width ratio is about 1.30.

The girdle 122 has a width equal to the width of the gemstone 112 and a length equal to the length of the gemstone 112 as shown in FIG. 6. The illustrative girdle 122 is highly polished. The girdle 122 is configured to mate with the light-emission system 14.

The girdle 122 includes a top edge 134 and a bottom edge 136 spaced apart from the top edge 134 as shown in FIG. 8. In the illustrative embodiment, the bottom edge 136 is spaced apart from the top edge 134 by a generally consistent distance around the circumference of the gemstone 112 to define a girdle height 138 as shown in FIG. 8. In some embodiments, the bottom edge 136 is spaced apart from the top edge 134 by a first distance in primary portions of the girdle 122 and by a second distance in secondary portions of the girdle 122. Each primary portion is positioned circumferentially between a pair of secondary portions. The first distance is greater than the second distance.

The girdle 122 has the relatively large girdle height 138 to increase a surface area engagement between the gemstone 112 and the light-emission system 14 as suggested in FIG. 8. In one example, the girdle height 138 is in a range of about or specifically 2 percent and about or specifically 15 percent of the width 128 of the gemstone 112. In another example, the girdle height 138 is in a range of about or specifically 4.5 percent and about or specifically 8.5 percent of the width 128. In another example, the girdle height 138 is in a range of about or specifically 5.5 percent and about or specifically 7.5 percent of the width 128. In another example, the girdle height 138 is about or specifically 6.5 percent of the width 128. In the illustrative embodiment, the girdle height 138 is 6.7 percent of the width 128. In the illustrative embodiment, the girdle height 138 is 0.33 millimeters.

In another example, the girdle height 138 is in a range of about or specifically 4 percent and about or specifically 8 percent of the width 128. In another example, the girdle height 138 is in a range of about or specifically 5 percent and about or specifically 7 percent of the width 128. In another example, the girdle height 138 is about or specifically 6 percent of the width 128.

The crown 120 extends from the girdle 122 away from the pavilion 124 as shown in FIG. 8. An outer crown surface 140 of the crown 120 and the top edge 134 of the girdle 122 define a crown angle 142 as shown in FIG. 8. In one example, the crown angle 142 is in a range of about or specifically 36 degrees to about or specifically 50 degrees. In another example, the crown angle 142 is in a range of about or specifically 39 degrees to about or specifically 46 degrees. In another example, the crown angle 142 is in a range of about or specifically 39 degrees to about or specifically 45 degrees. In another example, the crown angle 142 is in a range of about or specifically 39 degrees to about or specifically 44 degrees. In another example, the crown angle 142 is in a range of about or specifically 40 degrees to about or specifically 46 degrees. In another example, the crown angle 142 is in a range of about or specifically 41 degrees to about or specifically 46 degrees. In another example, the crown angle 142 is in a range of about or specifically 44 degrees to about or specifically 46 degrees. In another example, the crown angle 142 is in a range of about or specifically 45 degrees to about or specifically 46 degrees.

In another example, the crown angle 142 is in a range of about or specifically 36 degrees to about or specifically 45 degrees. In another example, the crown angle 142 is in a range of about or specifically 38 degrees to about or specifically 42 degrees. In another example, the crown angle 142 is in a range of about or specifically 39 degrees to about or specifically 41 degrees. In another example, the crown angle 142 is about or specifically 40 degrees. In the illustrative embodiment, the crown angle 142 is 39.4 degrees.

The crown 120 includes a crown height 144 defined between a table 154 of the gemstone 112 and the top edge 134 of the girdle 122 as shown in FIG. 8. In one example, the crown height 144 is in a range of about or specifically 15 percent and about or specifically 19 percent of the width 128 of the gemstone 112. In another example, the crown height 144 is in a range of about or specifically 16 percent and about or specifically 18 percent of the width 128. In another example, the crown height 144 is about or specifically 17 percent of the width 128. In the illustrative embodiment, the crown height 144 is 16.5 percent of the width 128. In the illustrative embodiment, the crown height 144 is 0.82 millimeters.

In another example, the crown height 144 is in a range of about or specifically 16 percent and about or specifically 20 percent of the width 128. In another example, the crown height 144 is in a range of about or specifically 17 percent and about or specifically 19 percent of the width 128. In another example, the crown height 144 is about or specifically 18 percent of the width 128.

The pavilion 124 extends between and interconnects the girdle 122 and the culet 126 as shown in FIG. 8. The pavilion 124 includes a plurality of outer pavilion surfaces 146 that extend between and interconnect the girdle 122 and the culet 126. A pavilion angle 148 is defined between each outer pavilion surface 146 of the pavilion 124 and the bottom edge 136 of the girdle 122.

In one example, the pavilion angle 148 is in a range of about or specifically 36 degrees to about or specifically 50 degrees. In another example, the pavilion angle 148 is in a range of about or specifically 39 degrees to about or specifically 45 degrees. In another example, the pavilion angle 148 is in a range of about or specifically 40 degrees to about or specifically 45 degrees. In another example, the pavilion angle 148 is in a range of about or specifically 41 degrees to about or specifically 45 degrees. In another example, the pavilion angle 148 is in a range of about or specifically 42 degrees to about or specifically 45 degrees. In another example, the pavilion angle 148 is in a range of about or specifically 43 degrees to about or specifically 45 degrees.

In another example, the pavilion angle 148 is in a range of about or specifically 39 degrees to about or specifically 44 degrees. In another example, the pavilion angle 148 is in a range of about or specifically 39 degrees to about or specifically 43 degrees. In another example, the pavilion angle 148 is in a range of about or specifically 39 degrees to about or specifically 42 degrees. In another example, the pavilion angle 148 is in a range of about or specifically 39 degrees to about or specifically 40 degrees.

In another example, the pavilion angle 148 is in a range of about or specifically 36 degrees to about or specifically 45 degrees. In another example, the pavilion angle 148 is in a range of about or specifically 38 degrees to about or specifically 42 degrees. In another example, the pavilion angle 148 is in a range of about or specifically 39 degrees to about or specifically 41 degrees. In another example, the pavilion angle 148 is about or specifically 40 degrees. In the illustrative embodiment, the pavilion angle 148 is 39.2 degrees.

The pavilion 124 includes a pavilion depth 150 defined between the bottom edge 136 of the girdle 122 and the culet 126 as shown in FIG. 8. In one example, the pavilion depth 150 is in a range of about or specifically 37 percent and about or specifically 41 percent of the width 128 of the gemstone. In another example, the pavilion depth 150 is in a range of about or specifically 38 percent and about or specifically 40 percent of the width 128. In another example, the pavilion depth 150 is about or specifically 39 percent of the width 128. In the illustrative embodiment, the pavilion depth 150 is 38.3 percent of the width 128. In the illustrative embodiment, the pavilion depth 150 is 1.90 millimeters.

In another example, the pavilion depth 150 is in a range of about or specifically 38 percent and about or specifically 42 percent of the width 128 of the gemstone. In another example, the pavilion depth 150 is in a range of about or specifically 39 percent and about or specifically 41 percent of the width 128. In another example, the pavilion depth 150 is about or specifically 40 percent of the width 128.

The culet 126 is configured to mate with the light-emission system 14 as suggested in FIG. 2. The culet 126 is relatively oversized to increase a surface area engagement between the gemstone 112 and the light-emission system 14 for greater light absorption from the light-emission system 14 into the gemstone 112.

The culet 126 includes a culet width 152 (sometimes called culet diameter) as shown in FIG. 8. In one example, the culet width 152 is in a range of about or specifically 7.5 percent and about or specifically 20 percent of the width 128 of the gemstone 112. In another example, the culet width 152 is in a range of about or specifically 18 percent and about or specifically 22 percent of the width 128. In another example, the culet width 152 is in a range of about or specifically 19 percent and about or specifically 21 percent of the width 128. In another example, the culet width 152 is about or specifically 20 percent of the width 128. In the illustrative embodiment, the culet width 152 is about or specifically 18 percent of the width 128. In the illustrative embodiment, the culet width 152 is 0.99 millimeters.

In another example, the culet width 152 is in a range of about or specifically 9 percent and about or specifically 13 percent of the width 128. In another example, the culet width 152 is in a range of about or specifically 10 percent and about or specifically 12 percent of the width 128. In another example, the culet width 152 is about or specifically 11 percent of the width 128.

In the illustrative embodiment, the culet 126 is off-center. Illustratively, the culet 126 is off-center by 2.8 percent. The culet 126 may also be highly polished.

The gemstone 112 further includes a table 154 including a table width 156 as shown in FIG. 8. In one example, the table width 156 is in a range of about or specifically 45 percent and about or specifically 65 percent of the width 128 of the gemstone 112. In another example, the table width 156 is in a range of about or specifically 59 percent and about or specifically 63 percent of the width 128. In another example, the table width 156 is in a range of about or specifically 61 percent and about or specifically 62 percent of the width 128. In another example, the table width 156 is about or specifically 61.5 percent of the width 128. In the illustrative embodiment, the table width 56 is 61.1 percent of the width 128. In the illustrative embodiment, the table width 156 is 3.03 millimeters. The illustrative table 154 is off-center by 0.06 millimeters.

In another example, the table width 156 is in a range of about or specifically 51.5 percent and about or specifically 59 percent of the width 128. In another example, the table width 156 is in a range of about or specifically 54 percent and about or specifically 56.5 percent of the width 128. In another example, the table width 156 is about or specifically 55.25 percent of the width 128.

Another light-emitting jewelry piece 210 in accordance with the present disclosure is shown in FIGS. 9 and 10. The light-emitting jewelry piece 210 includes a gemstone 212, a light-emission system 214, a head 216, and the mounting 18. The gemstone 212 is a piece of material used to make an adornment such as, for example, a mineral, metal, rock, plastic, glass, colored gemstone, whether precious or non-precious, natural diamond, and lab-created diamond. The light-emission system 214 is configured to provide means for emitting light over time to cause visible light to be emitted through the gemstone 212. As such, the gemstone 212 may be viewed by a person when the light-emitting jewelry piece 210 is in a dusk to dark environment. The head 216 interconnects the gemstone 212 to the mounting 18. The mounting 18 secures the light-emitting jewelry piece 210 to a person or a personal adornment.

Illustratively, the gemstone 212 is a round-cut diamond. The gemstone 212 includes a crown 220, a girdle 222, a pavilion 224, and a culet 226 as shown in FIGS. 9 and 10.

The light-emission system 214 emits light over a period of time to illuminate the gemstone 212 as suggested in FIG. 10. In one example, the light-emission system 214 may emit a green light. In another example, the light-emission system 214 may emit a blue light. In still yet another example, the light-emission system 214 may emit any other suitable color of light. In other embodiments, the light-emission system 214 emits a plurality of colors of light.

The light-emission system 214 includes a light-emitting band 280 and a light-emitting disk 282 as shown in FIGS. 9 and 10. The light-emitting band 280 and the light-emitting disk 282 emit visible light through the gemstone 212 to illuminate the gemstone 212 in response to receiving and storing energy 72 (e.g., UV light or ambient light). As such, the gemstone 212 is illuminated in dark environments by the light-emission system 214 until the stored energy 72 is depleted. Light-emitting band 280 is spaced apart from light-emitting disk 282 relative to gemstone 212 to allow light to enter pavilion 224 between light-emitting band 280 and light-emitting disk 282. As a result, luster and brilliance in the gemstone in a bright or daylight environment may be maximized.

The light-emitting band 280 includes an upper portion 290 that extends about the girdle 222 of the gemstone 212 as shown in FIG. 10. In some examples, the light-emitting band 280 includes a lower portion 292 configured to extend around a portion of the pavilion 224. In the illustrative embodiment, the lower portion 292 of the light-emitting band 280 extends away from the upper portion 290 by a band angle and the band angle is about equal to the pavilion angle 248. In the illustrative embodiment, the lower portion 292 extends from upper portion 290 and terminates at a point on a portion of pavilion 224 so that the light-emitting band 280 is spaced apart from culet 226 relative to gemstone 212 to allow ambient light to enter gemstone 212 though pavilion 224 therebetween.

The upper portion 290 of light-emitting band 280 includes an upper surface 294 and a lower surface 296. Upper surface 294 of upper portion 290 is arranged to face upwardly away from light-emitting band 280. Lower surface 296 of upper portion 290 is arranged to face downwardly toward lower portion 292 of light-emitting band 280. Upper portion 290 of light-emitting band 280 is configured to engage girdle 222 and extend around gemstone 212.

The lower portion 292 of light-emitting band 280 includes an upper surface 298 and a lower surface 300. Upper surface 298 of lower portion 292 is arranged to face upwardly away from lower portion 292 of light-emitting band 280. Upper surface 298 of lower portion 292 is configured to engage lower surface 296 of upper portion 290. Lower surface 300 of lower portion 292 is arranged to face downwardly away from toward lower portion 292 of light-emitting band 280. Lower portion 292 of light-emitting band 280 is configured to engage pavilion 224 and extend around pavilion 224 and terminate in spaced-apart relation to culet cover 226.

The light-emitting band 280 is formed to include a gemstone-receiver aperture 270 sized to receive the gemstone 212 as shown in FIG. 9. The light-emitting band 280 is coupled to an exterior surface of the girdle 222. In the illustrative embodiment, the light-emitting band 280 is coupled to an exterior surface of the pavilion 224. Illustratively, the light-emitting band 280 is made from a photo-luminescent material. In one example, the photo-luminescent material includes phosphorous material and poly-vinyl chloride. In another example, the photo-luminescent material includes phosphorous material and an acrylic material. In another example, the photo-luminescent material may include a phosphorous material, poly-vinyl chloride, an acrylic material, mixtures thereof, or any other suitable alternative. In the illustrative embodiment, the light-emitting band 280 has a thickness of about 0.5 millimeters. In some embodiments, the light-emitting band 280 includes plastics material.

The light-emitting disk 282 illustratively forms a solid cylinder configured to mate with the culet 226 of the gemstone 212 as shown in FIG. 10. A top surface 283 of light-emitting disk 282 is coupled to an exterior surface 227 of the culet 226. Illustratively, the light-emitting disk 282 is made from a photo-luminescent material. In one example, the photo-luminescent material includes phosphorous material and poly-vinyl chloride. In another example, the photo-luminescent material includes phosphorous material and an acrylic material.

In another example, the photo-luminescent material may include a phosphorous material, poly-vinyl chloride, an acrylic material, mixtures thereof, or any other suitable alternative. In the illustrative embodiment, the light-emitting disk 282 has a thickness of about 0.5 millimeters. In some embodiments, the light-emitting disk 282 includes plastics material.

The head 216 includes a gem retainer 274, a culet support 276, and a plurality of prongs 278 as shown in FIGS. 9 and 10. The gem retainer 274 mates with the girdle 222 of the gemstone 212 and the light-emitting band 280 to retain the light-emitting band 280 between the gemstone 212 and the head 216 as shown in FIG. 10. In one example, the gem retainer 274 covers a top surface of the light-emitting band blocking a user from seeing light emitted directly from the top surface of the light-emitting band and directing that light back into the gemstone. The culet support 276 is located in spaced-apart relation to the gem retainer 274 and mates with the light-emitting disk 282 to retain the light-emitting disk 282 between the culet 226 of the gemstone 212 and the head 216 as suggested in FIG. 10. The prongs 278 extend between and interconnect the gem retainer 274 and the culet support 276.

Another light-emitting jewelry piece 310 in accordance with the present disclosure is shown in FIGS. 11-14. The light-emitting jewelry piece 310 includes a gemstone 312, a light-emission system 314, a head 316, and the mounting 18. The gemstone 312 is a piece of material used to make an adornment such as, for example, a mineral, metal, rock, plastic, glass, colored gemstone, whether precious or non-precious, natural diamond, and lab-created diamond. The light-emission system 314 is configured to receive a pear-cut gemstone and is configured to provide means for emitting light over time to cause visible light to be emitted through the gemstone 312 and to be viewed by a person when the light-emitting jewelry piece 310 is in a dusk to dark environment. The head 316 interconnects the gemstone 312 to the mounting 18. The mounting 18 secures the light-emitting jewelry piece 310 to a person or a personal adornment.

Illustratively, the gemstone 312 is a pear-cut diamond as shown in FIG. 12. The gemstone 312 includes a crown 320, a girdle 322, a pavilion 324, and a culet 326 as shown in FIG. 14.

Illustratively, the gemstone 312 has a width 328, a length 332, and a height 330 as shown in FIGS. 12-14. The width 328 of the illustrative gemstone 312 is 4.57 millimeters and the length 332 is 6.36 millimeters. The height 330 of the illustrative gemstone 312 is 3.15 millimeters. Dimensions of the gemstone 312 may be expressed by percentages of the width 328 of the gemstone 312. As an example, the height 330 of the illustrative gemstone 312 is 68.9 percent of the width 328 of the gemstone 312. As such, the illustrative gemstone 312 may be said to have a height 330 of 68.9 percent. In the illustrative embodiment, the gemstone 312 is about 0.63 carats in weight.

The pear-cut gemstone 312 includes a length-to-width ratio as suggested in FIG. 12. In one example, the length-to-width ratio is between about 1.0 and about 1.5. In the illustrative embodiment, the length-to-width ratio is about 1.39.

The girdle 322 is configured to mate with the light-emission system 314. The girdle 322 has a width equal to the width of the gemstone 312 and a length equal to the length of the gemstone 312 as shown in FIG. 12. The illustrative girdle 322 is highly polished.

The girdle 322 includes a top edge 334 and a bottom edge 336 spaced apart from the top edge 334 as shown in FIG. 14. In the illustrative embodiment, the bottom edge 336 is spaced apart from the top edge 334 by a generally consistent distance around the circumference of the gemstone 312 to define a girdle height 338 as shown in FIG. 14. In some embodiments, the bottom edge 336 is spaced apart from the top edge 334 by a first distance in primary portions of the girdle 322 and by a second distance in secondary portions of the girdle 322. Each primary portion is positioned circumferentially between a pair of secondary portions. The first distance is greater than the second distance.

The girdle 322 has the relatively large girdle height 338 to increase a surface area engagement between the gemstone 312 and the light-emission system 314 as suggested in FIG. 14. In one example, the girdle height 338 is in a range of about or specifically 2 percent and about or specifically 15 percent of the width 328 of the gemstone 312. In another example, the girdle height 338 is in a range of about or specifically 4.5 percent and about or specifically 8.5 percent of the width 328. In another example, the girdle height 338 is in a range of about or specifically 5.5 percent and about or specifically 7.5 percent of the width 328. In another example, the girdle height 338 is in a range of about or specifically 6.9 percent and about or specifically 7.5 percent of the width 328. In another example, the girdle height 338 is about or specifically 7.2 percent of the width 328. In the illustrative embodiment, the girdle height 338 is 0.33 millimeters.

In another example, the girdle height 338 is in a range of about or specifically 4 percent and about or specifically 8 percent of the width 328. In another example, the girdle height 338 is in a range of about or specifically 6 percent and about or specifically 8 percent of the width 328. In another example, the girdle height 338 is about or specifically 7 percent of the width 328.

The crown 320 extends from the girdle 322 away from the pavilion 324 as shown in FIG. 14. An outer crown surface 340 of the crown 320 and the top edge 334 of the girdle 322 define a crown angle 342. In one example, the crown angle 342 is in a range of about or specifically 36 degrees to about or specifically 50 degrees. In another example, the crown angle 342 is in a range of about or specifically 39 degrees to about or specifically 46 degrees. In another example, the crown angle 342 is in a range of about or specifically 39 degrees to about or specifically 45 degrees. In another example, the crown angle 342 is in a range of about or specifically 39 degrees to about or specifically 44 degrees. In another example, the crown angle 342 is in a range of about or specifically 40 degrees to about or specifically 46 degrees.

In another example, the crown angle 342 is in a range of about or specifically 41 degrees to about or specifically 46 degrees. In another example, the crown angle 342 is in a range of about or specifically 44 degrees to about or specifically 46 degrees. In another example, the crown angle 342 is in a range of about or specifically 45 degrees to about or specifically 46 degrees.

In another example, the crown angle 342 is in a range of about or specifically 36 degrees to about or specifically 45 degrees. In another example, the crown angle 342 is in a range of about or specifically 38 degrees to about or specifically 42 degrees. In another example, the crown angle 342 is in a range of about or specifically 39 degrees to about or specifically 41 degrees. In another example, the crown angle 342 is about or specifically 40 degrees. In the illustrative embodiment, the crown angle 342 is 40.1 degrees.

The crown 320 includes a crown height 344 defined between a table 354 of the gemstone 312 and the top edge 334 of the girdle 322 as shown in FIG. 14. In one example, the crown height 344 is in a range of about or specifically 15 percent and about or specifically 20 percent of the width 328 of the gemstone 312. In another example, the crown height 344 is in a range of about or specifically 17 percent and about or specifically 19 percent of the width 328. In another example, the crown height 344 is about or specifically 19 percent of the width 328. In the illustrative embodiment, the crown height 344 is 18.6 percent of the width 328. In the illustrative embodiment, the crown height 344 is 0.85 millimeters.

In another example, the crown height 344 is in a range of about or specifically 16 percent and about or specifically 20 percent of the width 328. In another example, the crown height 344 is about or specifically 18 percent of the width 328.

The pavilion 324 extends between and interconnects the girdle 322 and the culet 326 as shown in FIG. 14. The pavilion 324 includes a plurality of outer pavilion surfaces 346 that extend between and interconnect the girdle 322 and the culet 326. A pavilion angle 348 is defined between each outer pavilion surface 346 of the pavilion 324 and the bottom edge 336 of the girdle 322.

In one example, the pavilion angle 348 is in a range of about or specifically 36 degrees to about or specifically 50 degrees. In another example, the pavilion angle 348 is in a range of about or specifically 39 degrees to about or specifically 45 degrees. In another example, the pavilion angle 348 is in a range of about or specifically 40 degrees to about or specifically 45 degrees. In another example, the pavilion angle 348 is in a range of about or specifically 41 degrees to about or specifically 45 degrees. In another example, the pavilion angle 348 is in a range of about or specifically 42 degrees to about or specifically 45 degrees. In another example, the pavilion angle 348 is in a range of about or specifically 43 degrees to about or specifically 45 degrees.

In another example, the pavilion angle 348 is in a range of about or specifically 39 degrees to about or specifically 44 degrees. In another example, the pavilion angle 348 is in a range of about or specifically 39 degrees to about or specifically 43 degrees. In another example, the pavilion angle 348 is in a range of about or specifically 39 degrees to about or specifically 42 degrees. In another example, the pavilion angle 348 is in a range of about or specifically 39 degrees to about or specifically 40 degrees.

In another example, the pavilion angle 348 is in a range of about or specifically 36 degrees to about or specifically 45 degrees. In another example, the pavilion angle 348 is in a range of about or specifically 38 degrees to about or specifically 42 degrees. In another example, the pavilion angle 348 is in a range of about or specifically 39 degrees to about or specifically 41 degrees. In another example, the pavilion angle 348 is about or specifically 40 degrees. In the illustrative embodiment, the pavilion angle 348 is 40.4 degrees.

The pavilion 324 includes a pavilion depth 350 defined between the bottom edge 336 of the girdle 322 and the culet 326 as shown in FIG. 14. In one example, the pavilion depth 350 is in a range of about or specifically 37 percent and about or specifically 45 percent of the width 328 of the gemstone. In another example, the pavilion depth 350 is in a range of about or specifically 40 percent and about or specifically 44 percent of the width 328. In another example, the pavilion depth 350 is about or specifically 43 percent of the width 328. In the illustrative embodiment, the pavilion depth 350 is 42.9 percent of the width 328. In the illustrative embodiment, the pavilion depth 350 is 196 millimeters.

In another example, the pavilion depth 350 is in a range of about or specifically 38 percent and about or specifically 42 percent of the width 328 of the gemstone. In another example, the pavilion depth 350 is in a range of about or specifically 39 percent and about or specifically 41 percent of the width 328. In another example, the pavilion depth 350 is about or specifically 40 percent of the width 328.

The culet 326 is configured to mate with the light-emission system 314 as suggested in FIG. 2. The culet 326 is relatively oversized to increase a surface area engagement between the gemstone 312 and the light-emission system 314 for greater light absorption from the light-emission system 314 into the gemstone 312 as suggested in FIG. 13.

The culet 326 includes a culet width 352 (sometimes called culet diameter) as shown in FIG. 14. In one example, the culet width 352 is in a range of about or specifically 7.5 percent and about or specifically 20 percent of the width 328 of the gemstone 312. In another example, the culet width 352 is in a range of about or specifically 15 percent and about or specifically 19 percent of the width 328. In another example, the culet width 352 is in a range of about or specifically 16 percent and about or specifically 18 percent of the width 328. In another example, the culet width 352 is about or specifically 18 percent of the width 328. In the illustrative embodiment, the culet width 352 is about or specifically 17 percent of the width 328. In the illustrative embodiment, the culet width 352 is 0.78 millimeters.

In another example, the culet width 352 is in a range of about or specifically 18 percent and about or specifically 22 percent of the width 328. In another example, the culet width 352 is in a range of about or specifically 19 percent and about or specifically 21 percent of the width 328. In another example, the culet width 352 is about or specifically 20 percent of the width 328. The culet 326 may also be highly polished.

The gemstone 312 further includes a table 354 including a table width 356 as shown in FIGS. 12 and 14. In one example, the table width 356 is in a range of about or specifically 45 percent and about or specifically 65 percent of the width 328 of the gemstone 312. In another example, the table width 356 is in a range of about or specifically 51.5 percent and about or specifically 59 percent of the width 328. In another example, the table width 356 is in a range of about or specifically 54 percent and about or specifically 56.5 percent of the width 328. In another example, the table width 356 is about or specifically 55 percent of the width 328. In the illustrative embodiment, the table width 356 is 54.8 percent of the width 328. In the illustrative embodiment, the table width 356 is 2.50 millimeters.

In another example, the table width 356 is in a range of about or specifically 59 percent and about or specifically 63 percent of the width 328. In another example, the table width 356 is in a range of about or specifically 61 percent and about or specifically 62 percent of the width 328. In another example, the table width 356 is about or specifically 61.5 percent of the width 328.

The light-emission system 314 emits light over a period of time to illuminate the gemstone 312 as suggested in FIG. 11. In one example, the light-emission system 314 may emit a green light. In another example, the light-emission system 314 may emit a blue light. In still yet another example, the light-emission system 314 may emit any other suitable color of light. In other embodiments, the light-emission system 314 emits a plurality of colors of light.

The light-emission system 314 includes a light-emitting band 380 and a light-emitting disk 382 as shown in FIG. 11. The light-emitting band 380 and the light-emitting disk 382 emit visible light through the gemstone 312 to illuminate the gemstone 312 in response to receiving and storing energy 72 (e.g., UV light or ambient light). As such, the gemstone 312 is illuminated in dark environments by the light-emission system 314 until the stored energy 72 is depleted.

The light-emitting band 380 includes an upper portion that extends about the girdle 322 of the gemstone 312 as suggested in FIG. 11. In the illustrative embodiment, the light-emitting band 380 includes a lower portion configured to extend around a portion of the pavilion 324. In the illustrative embodiment, the lower portion of the light-emitting band 380 extends away from the upper portion by a band angle and the band angle is about equal to the pavilion angle 348.

The illustrative light-emitting band 380 is pear-cut shaped to extend around the pear-cut gemstone 312. The light-emitting band 380 is formed to include a gemstone-receiver aperture 370 sized to receive the gemstone 312. The light-emitting band 380 is coupled to an exterior surface of the girdle 322. In the illustrative embodiment, the light-emitting band 280 is coupled to an exterior surface of the pavilion 324. Illustratively, the light-emitting band 380 is made from a photo-luminescent material. In one example, the photo-luminescent material includes phosphorous material and poly-vinyl chloride. In another example, the photo-luminescent material includes phosphorous material and an acrylic material. In another example, the photo-luminescent material may include a phosphorous material, poly-vinyl chloride, an acrylic material, mixtures thereof, or any other suitable alternative. In the illustrative embodiment, the light-emitting band 380 has a thickness of about 0.5 millimeters. In some embodiments, the light-emitting band 380 includes plastics material.

The light-emitting disk 382 illustratively forms a solid cylinder configured to mate with the culet 326 of the gemstone 312 as suggested in FIG. 11. The light-emitting disk 382 is configured to couple to an exterior surface of the culet 326. Illustratively, the light-emitting disk 382 is made from a photo-luminescent material. In one example, the photo-luminescent material includes phosphorous material and poly-vinyl chloride. In another example, the photo-luminescent material includes phosphorous material and an acrylic material. In another example, the photo-luminescent material may include a phosphorous material, poly-vinyl chloride, an acrylic material, mixtures thereof, or any other suitable alternative. In the illustrative embodiment, the light-emitting disk 382 has a thickness of about 0.5 millimeters. In some embodiments, the light-emitting disk 382 includes plastics material.

The head 316 is configured to couple the gemstone 312 and light-emission system 314 with the mount 18 as suggested in FIG. 11. The illustrative head 316 includes a gem retainer 374, a culet support 376, and a plurality of prongs 378. The gem retainer 374 mates with the girdle 322 of the gemstone 312 and the light-emitting band 380 to retain the light-emitting band 380 between the gemstone 312 and the head 316. The culet support 376 is located in spaced-apart relation to the gem retainer 374 and mates with the light-emitting disk 382 to retain the light-emitting disk 382 between the culet 326 of the gemstone 312 and the head 316. The prongs 378 extend between and interconnect the gem retainer 374 and the culet support 376.

In one example, the gemstone may be a mineral, a crystal, metal, rock, plastic, glass, cubic zirconia, colored gemstone, whether precious or non-precious, natural diamond, lab-created diamond, combinations thereof, and/or any other suitable alternative. In one example where the gemstone has a refractive index which is different than diamond, the culet cover may be spaced apart from the culet of the gemstone. In this example, air may be located between the culet cover and the culet. One example of a gemstone where the culet cover is spaced apart from the culet is where the gemstone is a colored gemstone.

The invention claimed is:

1. A light-emitting jewelry piece consisting of:

a gemstone including a crown, a girdle, a pavilion, and a culet, the crown located in spaced-apart relation above the pavilion to locate the girdle therebetween, the pavilion located between the girdle and the culet;

a light-emission system coupled to an exterior surface of the gemstone, including at least the girdle, and configured to emit light over time in response to receiving and storing light to cause visible light to be emitted through the gemstone and viewed by a naked eye of a person when the light-emitting jewelry is in a dark environment, wherein the light-emission system includes a light-emitting band having an upper portion coupled to and extending outwardly away from at least the girdle and a lower portion coupled to and extending outwardly away from at least the pavilion, and a light-emitting disk spaced apart from and not of unitary construction with the light-emitting band, the light-emitting disk arranged to extend downwardly away from the culet; and a head including a gem retainer, a culet support, and a plurality of prongs extending between and interconnecting the gem retainer and the culet support;

wherein the gem retainer retains the light-emitting band between the girdle and the head;

wherein the culet support retains the light-emitting disk between the culet and the head;

wherein the head is not of unitary construction with the light-emitting band or the light-emitting disk; and wherein the head is configured to interconnect the gemstone to a mounting.

2. The light-emitting jewelry piece of claim 1, wherein the upper portion has an upper surface arranged to face upwardly away from the pavilion and a lower surface arranged to face downwardly toward the lower portion of the light-emitting band and the lower portion has an upper surface coupled to the lower surface of the upper portion and a lower surface arranged to face downwardly toward the culet.

3. The light-emitting jewelry piece of claim 1, wherein the lower portion extends from the upper portion toward the culet and terminates at a point on the pavilion so that the light-emitting band is spaced apart from the culet to allow light to enter the gemstone though the pavilion.

4. The light-emitting jewelry piece of claim 1, wherein the light-emitting disk includes a top surface coupled with an exterior surface of the culet.

5. The light-emitting jewelry piece of claim 1, wherein the light-emitting band and the light-emitting disk are made of a mixture of a plastics material and a phosphorous material.

6. The light-emitting jewelry piece of claim 1, wherein the light-emitting band and the light-emitting disk are made from a photo-luminescent material.

7. The light-emitting jewelry piece of claim 1, wherein the light-emitting band has a thickness of about 0.5 millimeters.

8. The light-emitting jewelry piece of claim 1, wherein a crown angle is defined between an outer surface of the crown and a top edge of the girdle and the crown angle is in a range of 40 degrees to 45 degrees.

9. The light-emitting jewelry piece of claim 8, wherein the crown angle is about 45 degrees.

10. The light-emitting jewelry piece of claim 1, wherein a pavilion angle is defined between an outer surface of the pavilion and a bottom edge of the girdle and the pavilion angle is in a range of 40 degrees to 50 degrees.

11. The light-emitting jewelry piece of claim 10, wherein the pavilion angle is in a range of 40 degrees and 42 degrees.

12. The light-emitting jewelry piece of claim 10, wherein the pavilion angle is in a range of 40 degrees and 41 degrees.

13. The light-emitting jewelry piece of claim 1, wherein the girdle thickness is 10 percent to 15 percent larger than the girdle of an American Standard or Tolkowsky Brilliant ideal cut diamond.

14. The light-emitting jewelry piece of claim 13, wherein the culet is about 13 percent larger in diameter than the culet of an American Standard or Tolkowsky Brilliant ideal cut gemstone to increase light transmission from the light-emission system to the gemstone.

15. The light-emitting jewelry piece of claim 1, wherein the upper portion extends parallel to the girdle and wherein the lower portion extends parallel to the pavilion.

16. The light-emitting jewelry piece of claim 2, wherein the gem retainer covers the upper surface of the light-emitting band.

17. The light-emitting jewelry piece of claim 1, wherein the lower portion extends away from the upper portion by a band angle and the band angle is in a range of 40 degrees to 50 degrees.

18. The light-emitting jewelry piece of claim 17, wherein the band angle is about 41.5 degrees.

19. A light-emitting jewelry piece consisting of:

a gemstone including a crown, a girdle, a pavilion, and a culet, the crown located in spaced-apart relation above the pavilion to locate the girdle therebetween, the pavilion located between the girdle and the culet;

a light-emission system coupled to an exterior surface of the gemstone, including at least the girdle, and configured to emit light over time in response to receiving and storing light to cause visible light to be emitted through the gemstone and viewed by a naked eye of a person when the light-emitting jewelry is in a dark environment, wherein the light-emission system includes a light-emitting band having an upper portion coupled to and extending outwardly away from at least the girdle and a lower portion coupled to and extending outwardly away from at least the pavilion, and a light-emitting disk spaced apart from and not of unitary construction with the light-emitting band, the light-emitting disk arranged to extend downwardly away from the culet; and a head including a gem retainer, a culet support, and a plurality of prongs extending between and interconnecting the gem retainer and the culet support; and a mounting;

wherein the gem retainer retains the light-emitting band between the girdle and the head;

wherein the culet support retains the light-emitting disk between the culet and the head;

wherein the head is not of unitary construction with the light-emitting band or the light-emitting disk; and wherein the head is configured to interconnect the gemstone to the mounting.

* * * * *